US012181241B2

(12) United States Patent
Dawson, Jr.

(10) Patent No.: US 12,181,241 B2
(45) Date of Patent: Dec. 31, 2024

(54) PISTOL COMPENSATOR COMPONENTS, SYSTEMS, AND METHODS

(71) Applicant: David J. Dawson, Jr., Florence, TX (US)

(72) Inventor: David J. Dawson, Jr., Florence, TX (US)

( * ) Notice: Subject to any disclaimer, the term of this patent is extended or adjusted under 35 U.S.C. 154(b) by 0 days.

(21) Appl. No.: 18/077,159

(22) Filed: Dec. 7, 2022

(65) Prior Publication Data

US 2023/0175797 A1 Jun. 8, 2023

Related U.S. Application Data

(60) Provisional application No. 63/287,523, filed on Dec. 8, 2021.

(51) Int. Cl.
*F41A 21/36* (2006.01)
*F41A 3/86* (2006.01)
*F41A 3/88* (2006.01)

(52) U.S. Cl.
CPC ..... *F41A 3/88* (2013.01)

(58) Field of Classification Search
CPC ..... F41A 21/36; F41A 21/325
See application file for complete search history.

(56) References Cited

U.S. PATENT DOCUMENTS 2,935,000 A * 5/1960 Mowrey ..... F41A 21/36 89/196
4,485,723 A * 12/1984 Sarony ..... F41A 3/86 89/198
4,691,614 A * 9/1987 Leffel ..... F41A 21/36 89/14.3
4,893,426 A * 1/1990 Bixler ..... F16B 7/20 89/14.05
4,930,397 A * 6/1990 Seidler ..... F41A 21/36 89/14.3
5,076,137 A * 12/1991 Paredes ..... F41A 21/36 89/14.3

(Continued)

OTHER PUBLICATIONS

Dawson Precision, "Guiderod, for 1911 Pistols . . . by Dawson Precision" 2019 (based on review date) <https://dawsonprecision.com/guiderod-for-1911-pistols-5-springfield-trp-operator-or-professional-model-5-prodigy-tool-less-by-dawson-precision/> (Year: 2019).*

(Continued)

*Primary Examiner* — Derrick R Morgan
(74) *Attorney, Agent, or Firm* — Lauff Law PLLC

(57) ABSTRACT

In a preferred embodiment, a pistol compensator system comprises a compensator, an elastomeric spacer, an assortment of variously sized shims, a spring guide rod, and a spring plug. The compensator of this system comprises a body, a barrel cavity, a threaded bore, an oval rod cavity, and a plug cavity. The spring plug of this system comprises a latch extension. The spring guide rod of this system comprises a muzzle end. When this preferred embodiment is installed on a pistol, if the pistol is in battery (slide closed) the latch extension is disposed in the plug cavity, and if the pistol is out of battery (slide back) the muzzle end of the guide rod is disposed in the rod cavity. In this preferred embodiment, the compensator is tensioned to the end of the barrel by the elastomeric spacer and a shim.

4 Claims, 18 Drawing Sheets

(56) References Cited

U.S. PATENT DOCUMENTS

| | | | | |
|---|---|---|---|---|
| 5,698,810 | A * | 12/1997 | Rose | F41A 21/32 89/14.3 |
| 8,250,962 | B1 * | 8/2012 | Guenther | F41A 21/28 89/14.3 |
| 8,539,706 | B1 * | 9/2013 | Vieweg | F41A 25/10 42/1.06 |
| 9,709,355 | B2 * | 7/2017 | Joplin | F41A 21/36 |
| 10,077,959 | B2 | 9/2018 | Fumia et al. | |
| 10,156,412 | B1 * | 12/2018 | Price | F41A 21/36 |
| 10,180,300 | B2 | 1/2019 | Schirmer et al. | |
| 10,527,380 | B1 | 1/2020 | Price | |
| 10,634,441 | B2 | 4/2020 | Fumia et al. | |
| 10,731,939 | B2 | 8/2020 | Na et al. | |
| 10,767,952 | B1 * | 9/2020 | Till | F41A 21/325 |
| 10,809,033 | B2 | 10/2020 | Tindal | |
| 11,015,895 | B2 | 5/2021 | Na et al. | |
| 11,156,423 | B2 * | 10/2021 | Winterseth | F41A 21/34 |
| 11,530,887 | B2 * | 12/2022 | Mooney | F41A 25/12 |
| 2008/0156183 | A1 * | 7/2008 | Brittingham | F41A 21/30 89/14.4 |
| 2010/0024274 | A1 * | 2/2010 | Lippard | F41A 19/43 42/70.05 |
| 2012/0103176 | A1 * | 5/2012 | Latka | F41A 21/325 89/14.4 |
| 2014/0075800 | A1 * | 3/2014 | Morris, Jr. | F41A 21/36 42/1.06 |
| 2016/0010936 | A1 * | 1/2016 | Moon | F41A 21/38 89/14.3 |
| 2018/0058792 | A1 * | 3/2018 | Schirmer | F41A 21/36 |
| 2018/0073828 | A1 * | 3/2018 | Niswander | F41A 21/325 |
| 2018/0328690 | A1 * | 11/2018 | Gangl | F16B 39/24 |
| 2019/0011209 | A1 * | 1/2019 | Chavez | F41A 21/36 |
| 2019/0101350 | A1 * | 4/2019 | Hall | F41A 21/325 |
| 2019/0390930 | A1 * | 12/2019 | Fan | F41A 21/36 |
| 2020/0011630 | A1 * | 1/2020 | Niswander | F41A 21/34 |
| 2020/0025500 | A1 * | 1/2020 | Tindal | F41A 21/36 |
| 2020/0141681 | A1 * | 5/2020 | Na | F41A 21/36 |
| 2020/0173752 | A1 * | 6/2020 | Wolf | F41A 21/325 |
| 2020/0408478 | A1 | 12/2020 | Tindal | |
| 2022/0196352 | A1 * | 6/2022 | Mooney | F41A 25/12 |
| 2023/0228515 | A1 * | 7/2023 | Roe | F41G 1/02 89/14.05 |
| 2023/0266089 | A1 * | 8/2023 | Krnezic | F41A 21/325 89/14.3 |

OTHER PUBLICATIONS

Boomarms, "Bomber CNC Steel Barrel . . . GBB" , <https://boomarms.com/fr/products/bomber-cnc-steel-barrel-ha-style-aluminum-compensator-m18-version-set-for-sig-vfc-m18-gbb-black?pr_prod_strat=use_description&pr_rec_id=caa929883&pr_rec_pid=6759172145239&pr_ref_pid=6759672447063&pr_seq=uniform> (Year: 2023).*

Tactical Dev, "Compensators mounting techniques, the right one for you?" <https://www.youtube.com/watch?v =-mafxG6vhcA&t=208s> times 2:55-3:10 (Year: 2021).*

* cited by examiner

PISTOL COMPENSATOR COMPONENTS, SYSTEMS, AND METHODS

CROSS REFERENCE TO RELATED APPLICATIONS

This application claims the benefit under 35 U.S.C. § 119(e) of U.S. Provisional Patent Application Ser. No. 63/287,523 filed Dec. 8, 2021, which is incorporated herein by reference.

BACKGROUND

Compensators for pistols may provide several advantages. For example, a compensator may help reduce the recoil generated in the hand when firing a pistol. Also, a compensator may reduce the muzzle flip generated by firing the pistol.

Typically, a compensator is deployed with one or more chambers arrayed along the trajectory that a projectile follows when leaving the cartridge. Frequently, such a chamber may be configured with a generally vertical exit wall opposite the opening in the chamber where the projectile enters the chamber. A chamber typically is open at the top if it is deployed to reduce muzzle flip. A portion of the gases propelling a bullet through the chamber strikes the exit wall, thus imparting a force generally parallel to the barrel and directed away from the hand holding the pistol. This is the force that helps reduce recoil in the hand holding the pistol. In addition, a portion of those gases exits the vertical opening, thus imparting a downward force on the muzzle to help reduce muzzle flip.

In many pistol compensator deployments, a compensator may be attached to a barrel using interlocking threads. Even when other attachment means are used, it generally is preferable to provide means for deterring unintended rotation of a compensator about the barrel. Some known means for preventing such rotation include adhesives, set screws, and pins. This disclosure provides additional means for deterring unintended rotation of a compensator about the barrel.

SUMMARY

In a preferred embodiment, a pistol compensator system comprises a compensator, an elastomeric spacer, an assortment of variously sized shims, a spring guide rod, and a spring plug. The compensator of this system comprises a body, a barrel cavity, a threaded bore, an oval rod cavity, and a plug cavity. The spring plug of this system comprises a latch extension. The spring guide rod of this system comprises a muzzle end. When this preferred embodiment is installed on a pistol, if the pistol is in battery (slide closed) the latch extension is disposed in the plug cavity, and if the pistol is out of battery (slide back) the muzzle end of the guide rod is disposed in the rod cavity. In this preferred embodiment, the compensator is tensioned to the end of the barrel by the elastomeric spacer and a shim disposed in the barrel cavity between the compensator body and the muzzle face of the barrel.

This disclosure is made generally with reference to use for a "1911" or "2011" style pistol, but other types of pistols that comprise a camming barrel, a spring guide rod extending to the muzzle end of the slide, and a spring plug in the muzzle end of the slide may be configurable for use of the principles of the compensator components, systems, and methods disclosed herein.

DETAILED DESCRIPTION

Figure 1:
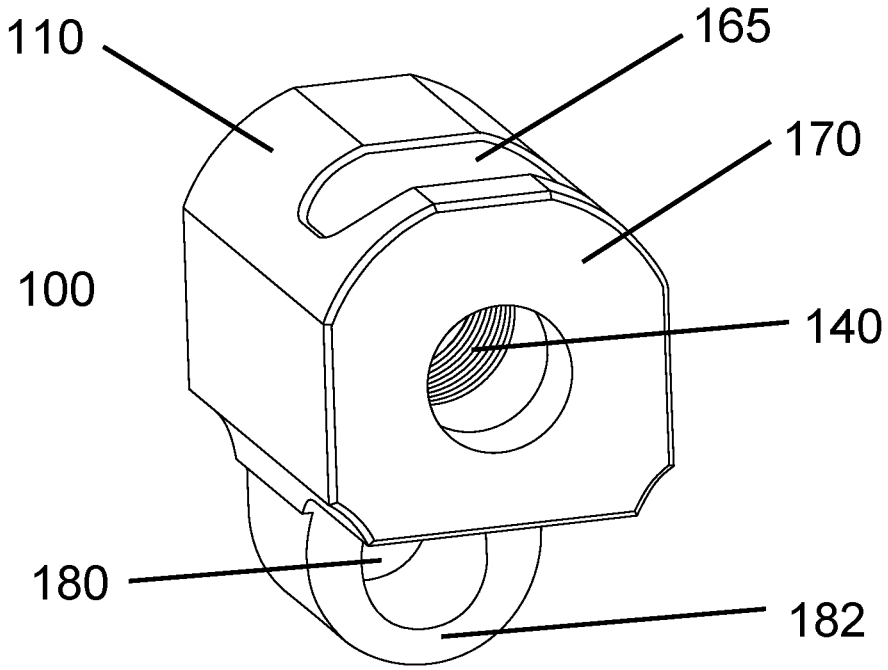
FIG. 1 and FIG. 2 depict perspective views of a preferred embodiment of a pistol compensator.
Figure 2:
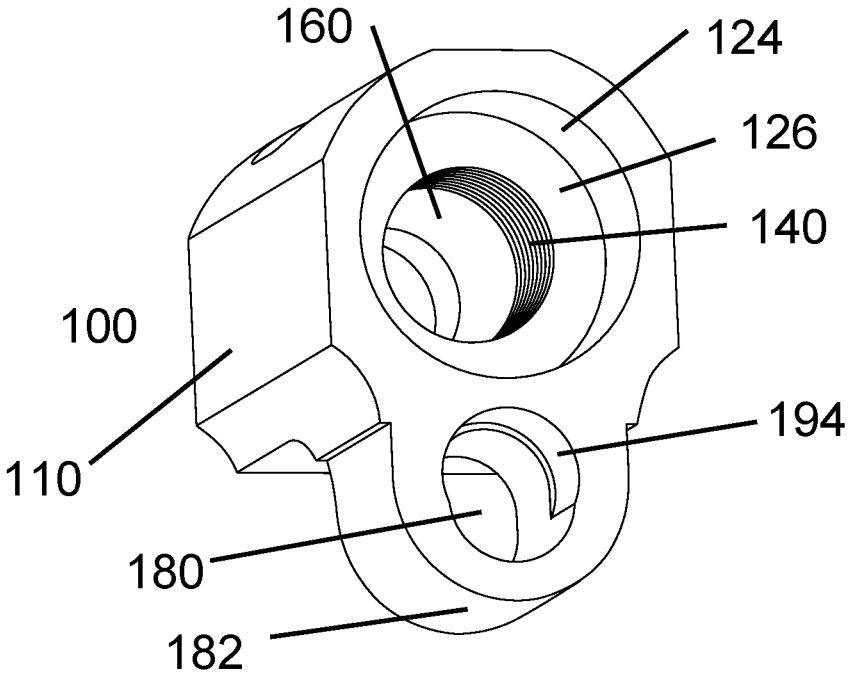

FIG. 1 and FIG. 2 depict perspective views of a preferred embodiment of a pistol compensator. FIG. 1 is a view from the upper right front and identifies several aspects of compensator 100, including body 110, gas chamber top opening 165, muzzle face 170, threads 140, rod cavity 180, and rod cavity bottom 182. FIG. 2 depicts is view from the lower left rear of the pistol compensator shown in FIG. 1, and identifies several additional aspects of compensator 100, including body 110, barrel cavity seating face 126, barrel cavity wall 124, threads 140, gas chamber 160, plug cavity wall 194, rod cavity 180, and rod cavity bottom 182.

Figure 3:
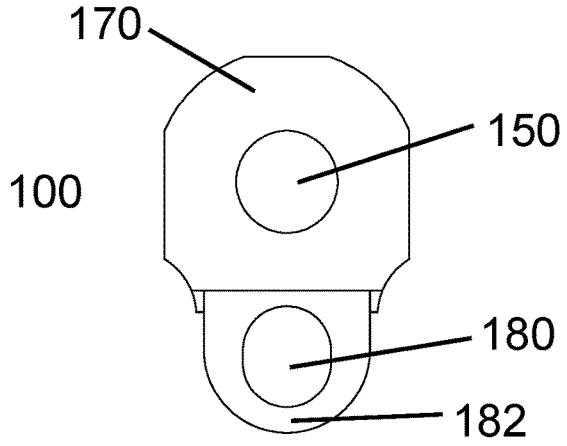
FIG. 3 through FIG. 8 depict elevation views of the compensator embodiment shown in FIG. 1 and FIG. 2.
Figure 4:
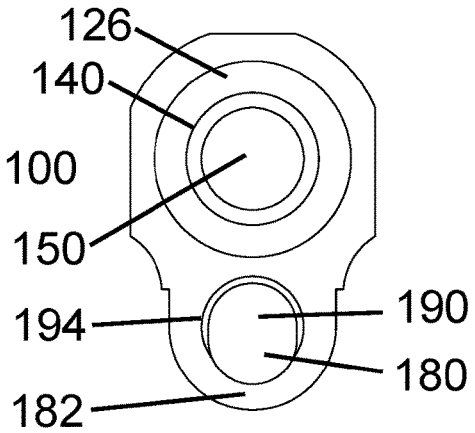
Figure 5:
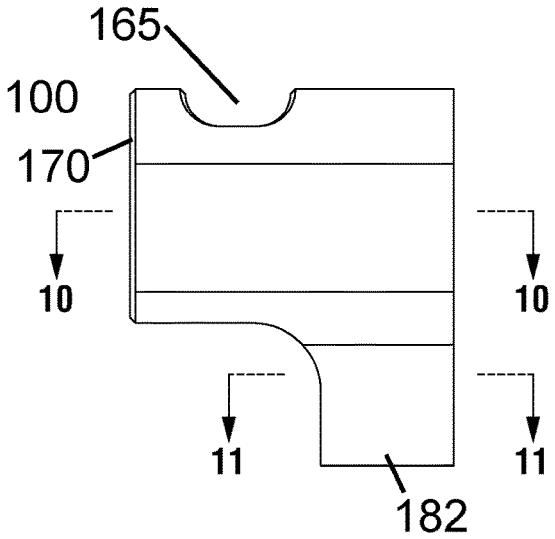
Figure 6:
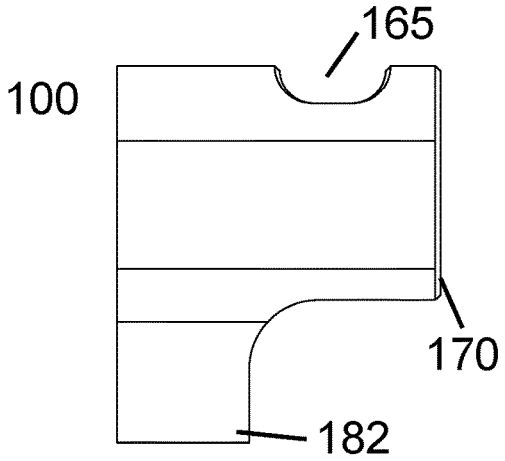
Figure 7:
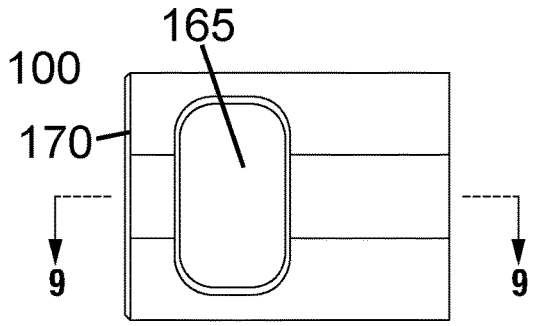
Figure 8:
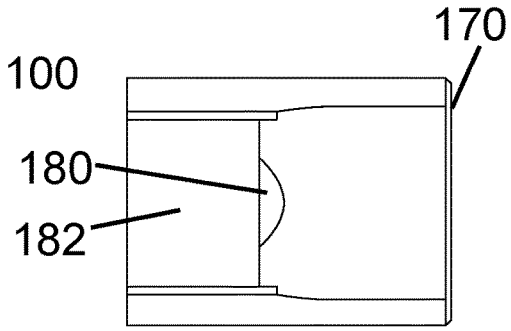

FIG. 3 through FIG. 8 depict elevation views of compensator 100 shown in FIG. 1 and FIG. 2. FIG. 3 is a front view, and identifies muzzle face 170, exit bore 150, rod cavity 180, and rod cavity bottom 182. In this embodiment, rod cavity 180 has an oval profile, with the upper wall having the form of a longitudinal half of a right circular cylinder and the lower wall also having the form of a longitudinal half of an upright circular cylinder. FIG. 4 is a rear view, and identifies rod cavity bottom 182, barrel cavity seating face 126, threads 140, and exit bore 150. FIG. 4 also depicts plug cavity 190 and associated plug cavity wall 194. As shown, plug cavity 190 is formed as a partial upright circular cylindrical boring having a central axis parallel to threaded bore 130 and exit bore 150, with the bottom part of the circular cylinder open to rod cavity 180. Accordingly, plug cavity wall 194 forms a partial cylindrical wall. FIG. 5 is a left elevation view and FIG. 6 is a right elevation view of compensator 100, both identifying gas chamber top opening 165, muzzle face 170, and rod cavity bottom 182. In addition, FIG. 5 identifies the cutting planes associated with the cross-sectional views shown in FIG. 10 and FIG. 11. FIG. 7 is a top plan view of compensator 100, identifying gas chamber top opening 165, muzzle face 170, and the cutting plane associated with the cross-sectional view shown in FIG. 9. FIG. 8 is a bottom plan view of compensator 100, identifying muzzle face 170, a portion of the front opening of rod cavity 180, and rod cavity bottom 182.

Figure 9:
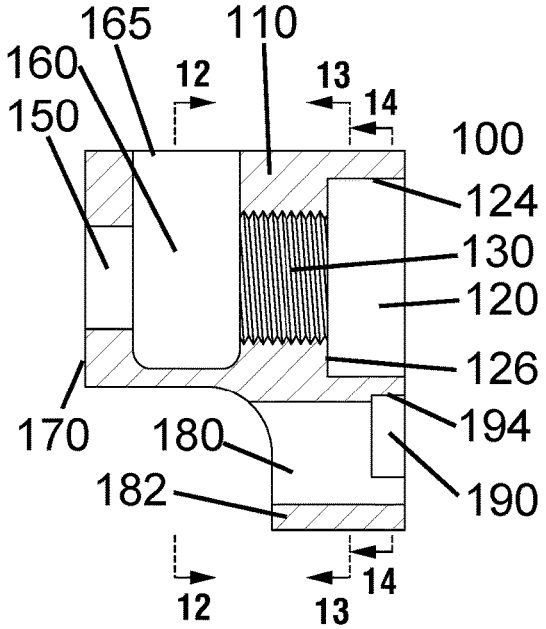
FIG. 9 is a cross sectional view taken along reference line 9 9 of the compensator embodiment shown in FIG. 7.
Figure 10:
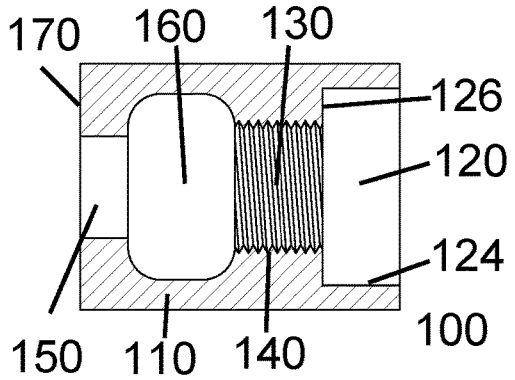
FIG. 10 is a cross sectional view taken along reference line 10 10 of the compensator embodiment shown in FIG. 5
Figure 11:
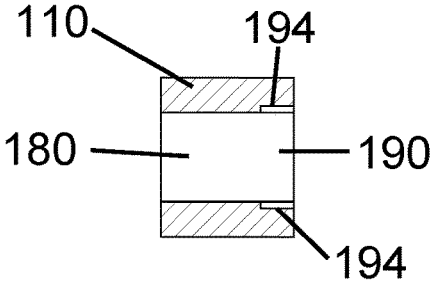
FIG. 11 is a cross sectional view taken along reference line 11 11 of the compensator embodiment shown in FIG. 5.

FIG. 9 through FIG. 14 are cross-sectional views of compensator 100 shown in FIG. 1 through FIG. 8. The aspects of compensator 100 identified in the vertical cross-sectional view of FIG. 9 include body 110, gas chamber 160, gas chamber top opening 165, muzzle face 170, and rod cavity bottom 182. FIG. 9 also identifies exit bore 150, threaded bore 130, and barrel cavity 120, which in this embodiment are collinear cylindrical borings, with threads 140 cut in threaded bore 130. As shown, barrel cavity 120 comprises cylindrical barrel cavity wall 124 and barrel cavity seating face 126, which in this embodiment is generally planar and perpendicular to the common central longitudinal axis of exit bore 150, threaded bore 130, and barrel cavity 120. FIG. 9 also depicts rod cavity 180 and plug cavity 190, with plug cavity wall 194 formed into a portion of the interior wall of rod cavity 180. FIG. 9 also identifies the cutting planes associated with the cross-sectional views shown in FIG. 12 through FIG. 14. The horizontal cross-sectional view of FIG. 10 identifies body 110, muzzle face 170, and concentric circular bores of exit bore 150, threaded bore 130, and barrel cavity 120. FIG. 10 further identifies threads 140 formed in threaded bore 130, and barrel cavity wall 124 and barrel cavity seating face 126 formed in barrel cavity 120. FIG. 11 presents a horizontal cross-sectional view of the lower part of compensator 100, identifying body 110, rod cavity 180, and plug cavity 190 with its associated plug cavity wall 194 formed in a portion of the wall of rod cavity 180.

Figure 12:
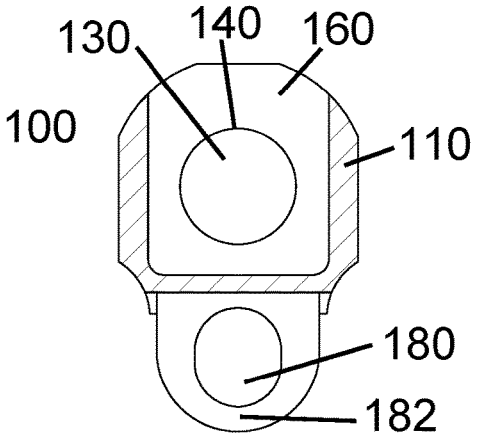
FIG. 12 is a cross sectional view taken along reference line 12 12 of the compensator embodiment shown in FIG. 9.
Figure 13:
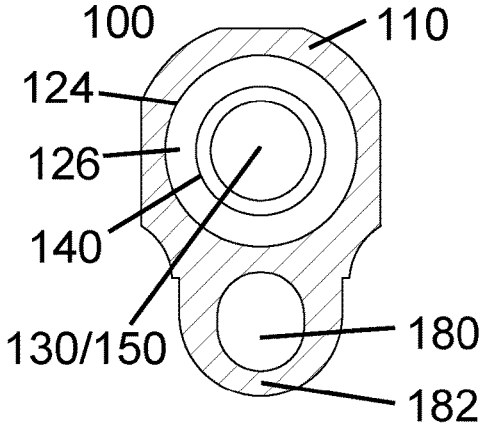
FIG. 13 is a cross sectional view taken along reference line 13 13 of the compensator embodiment shown in FIG. 9.
Figure 14:
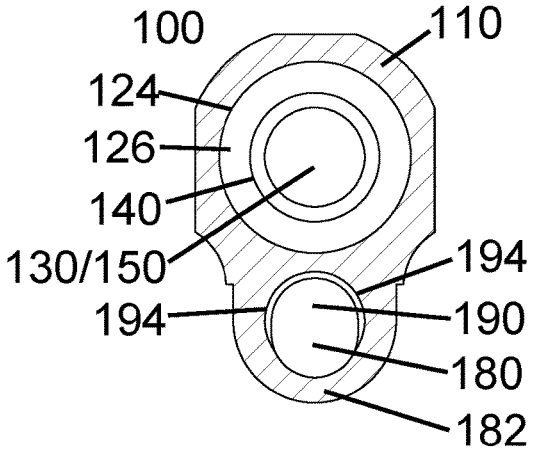
FIG. 14 is a cross sectional view taken along reference line 14 14 of the compensator embodiment shown in FIG. 9.

The vertical cross-sectional view of FIG. 12 identifies body 110, rod cavity bottom 182, threaded bore 130, a portion of threads 140 formed on the wall of threaded bore 130, gas chamber 160 open at the top (i.e., gas chamber top opening 165), and the oval profile of rod cavity 180. FIG. 13 presents a vertical cross-sectional view taken along a mid-section of rod cavity 180, and identifies body 110, rod cavity bottom 182, concentric barrel cavity 120 and exit bore 150, a portion of threads 140, barrel cavity wall 124, barrel cavity seating face 126, and the oval cross-sectional profile of rod cavity 180. The vertical cross-sectional view of FIG. 14 is taken toward the rear of rod cavity 180, and identifies the same aspects identified in FIG. 13, along with plug cavity 190 and its associated plug cavity wall 194 formed in the upper rear portion of rod cavity 180.

Figure 23:
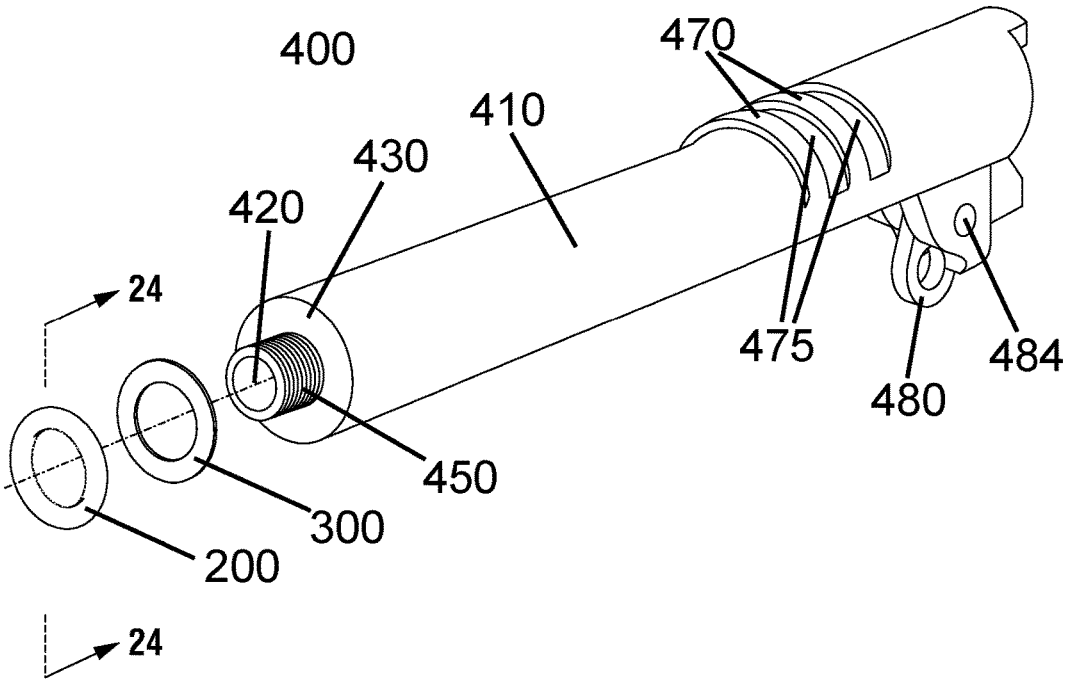
FIG. 23 and FIG. 24 depict a preferred embodiments of a barrel, a shim, and an O ring, with the cross section view of FIG. 24 taken along reference line 24 24 of FIG. 23.
Figure 24:
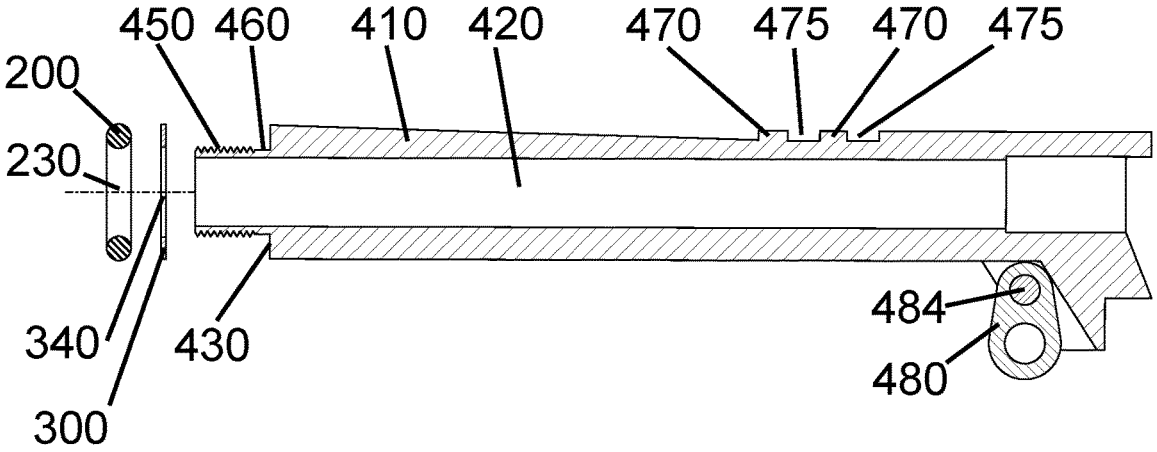

Turning to FIG. 23 and FIG. 24, the aspects of a preferred embodiment of a pistol barrel for use with the compensator 100 depicted in FIG. 1 through FIG. 16 are identified. As shown in these figures, this barrel 400 comprises barrel tube 410 which tapers along the top from the muzzle end toward the breach end, forming the front of a first of the locking lugs 470. The second of the locking lugs 470 is formed between a pair of locking recesses 475. Link 480 is supported at the lower breach end of barrel 400 by link pin 484. At the muzzle end of barrel 400, the diameter of barrel 400 is reduced and threaded with threads 450. Preferably, threads 450 are separated from the larger diameter barrel tube 410 by unthreaded shoulder 460, and the smaller diameter muzzle portion of barrel 400 transitions to the larger diameter barrel tube 410 at muzzle face 430. in this preferred embodiment, muzzle face 430 is generally planar and perpendicular to the central axis of the barrel's inner bore 420. FIG. 23 and FIG. 24 also depict an O-ring 200 and a shim 300 comprised in a preferred embodiment of the pistol compensator system disclosed herein.

Figure 15:
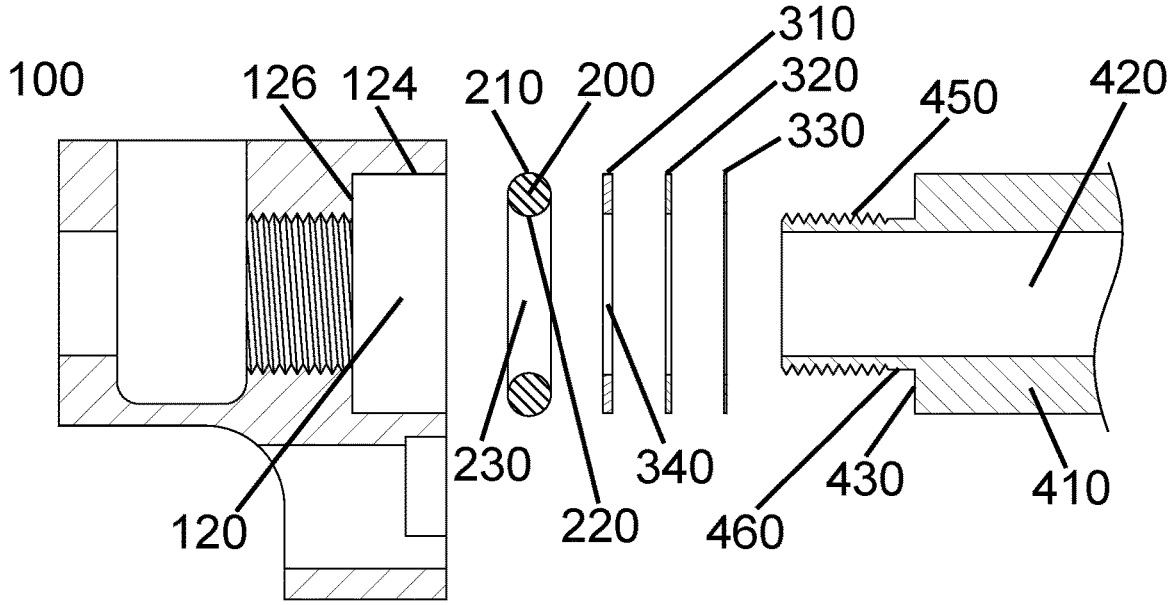
FIG. 15 and FIG. 16 reference the cross sectional views of FIG. 9 and FIG. 24 to illustrate use of the compensator embodiment depicted in FIG. 1 through FIG. 14 with the barrel embodiment depicted in FIG. 23 and FIG. 24.
Figure 16:
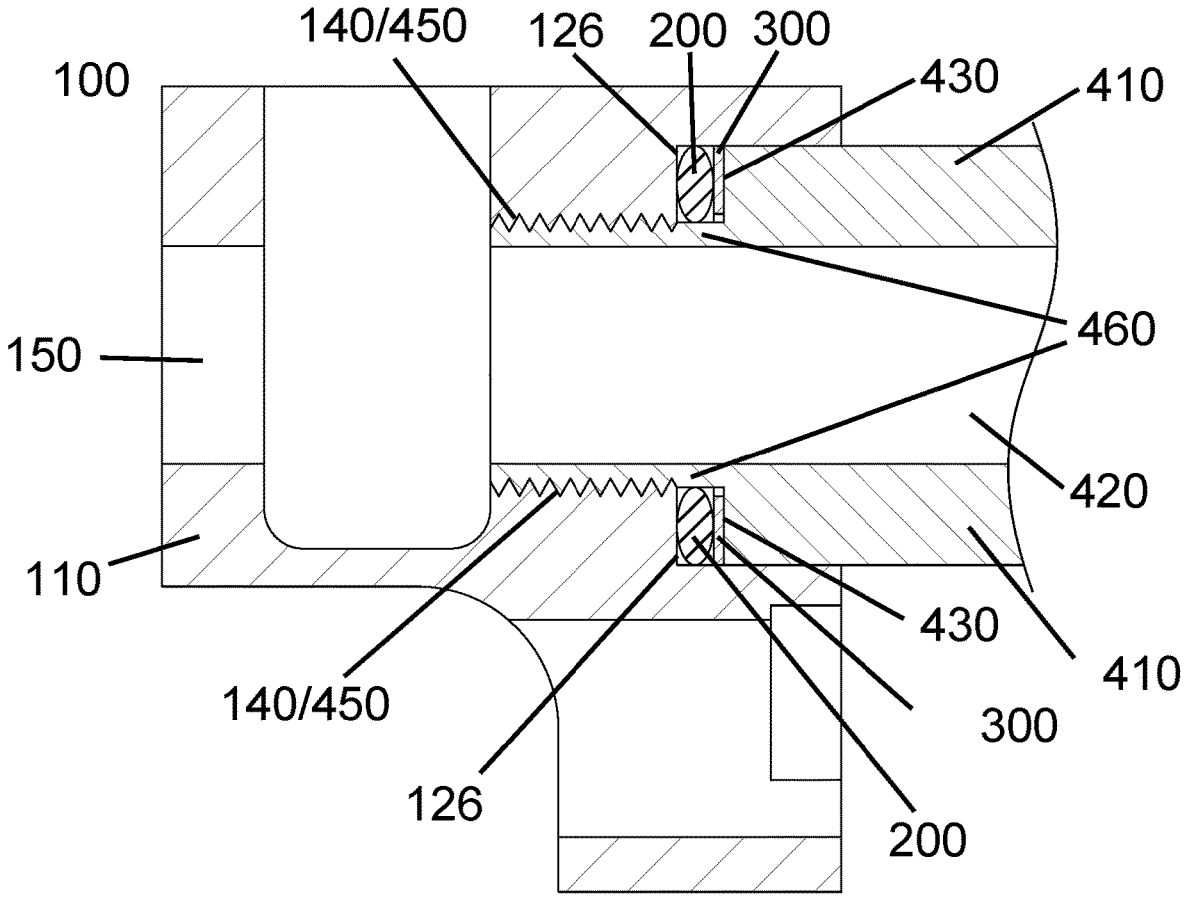

Returning to FIG. 15 and FIG. 16, the cross-sectional view of FIG. 9 and FIG. 24 are referenced to illustrate use of the preferred embodiment of compensator 100 depicted in FIG. 1 through FIG. 14 with the preferred embodiment of barrel 400 of FIG. 23 and FIG. 24. A preferred embodiment of a pistol compensator system may comprise compensator 100, an elastomeric spacer such as O-ring 200, and preferably an assortment of spacers having different thicknesses, such as thick shim 310, intermediate shim 320, and thin shim 330, as depicted in FIG. 15. Preferably, the shims are sized such that a secure attachment of compensator 100 to barrel 400 is accomplished with the use of only one shim 300, as depicted in FIG. 16. When compensator 100 is rotated about barrel 400 with compensator threads 140 engaged and interoperating with barrel threads 450 to achieve a secure attachment of compensator 100 to barrel 400, O-ring 200 preferably is configured in a compressed state as shown in FIG. 16.

Figure 17:
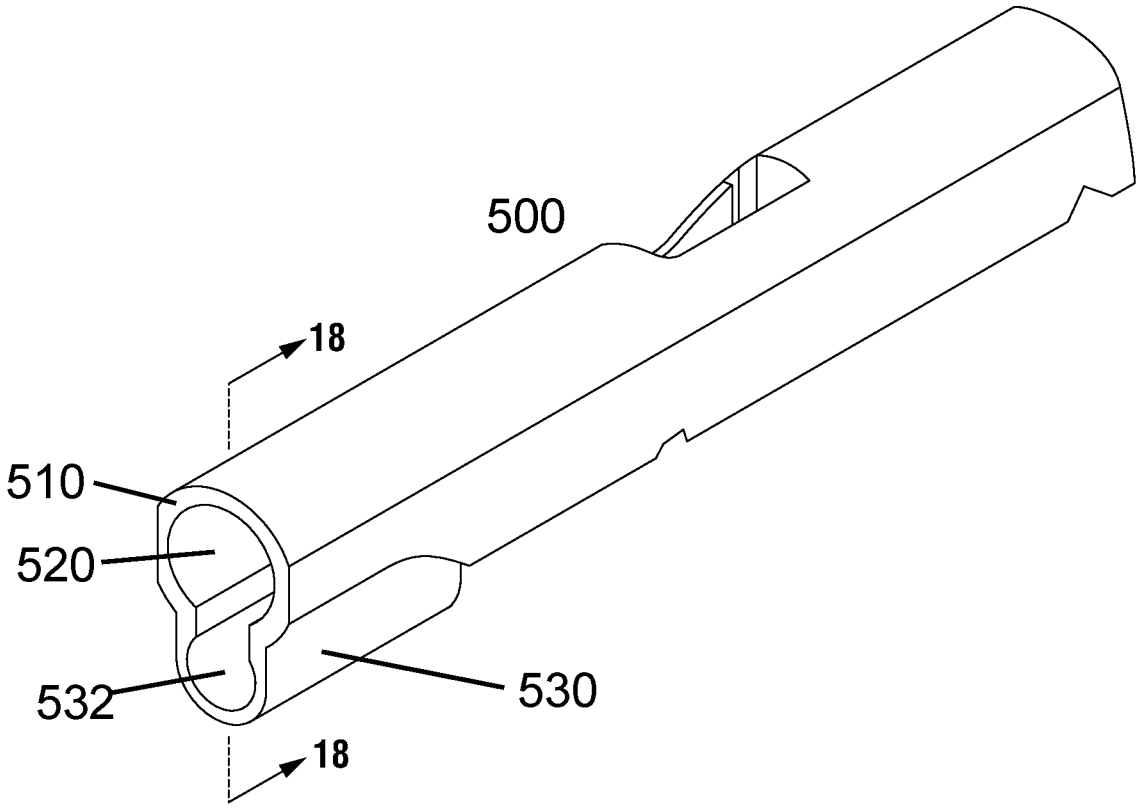
FIG. 17 and FIG. 18 present a simplified depiction of an embodiment of a pistol slide that may be used with the compensator embodiment depicted in FIG. 1 through FIG. 14 and the barrel embodiment depicted in FIG. 23 and FIG. 24, with the cross section view of FIG. 18 taken along reference line 18 18 of the slide embodiment shown in FIG. 17.
Figure 18:
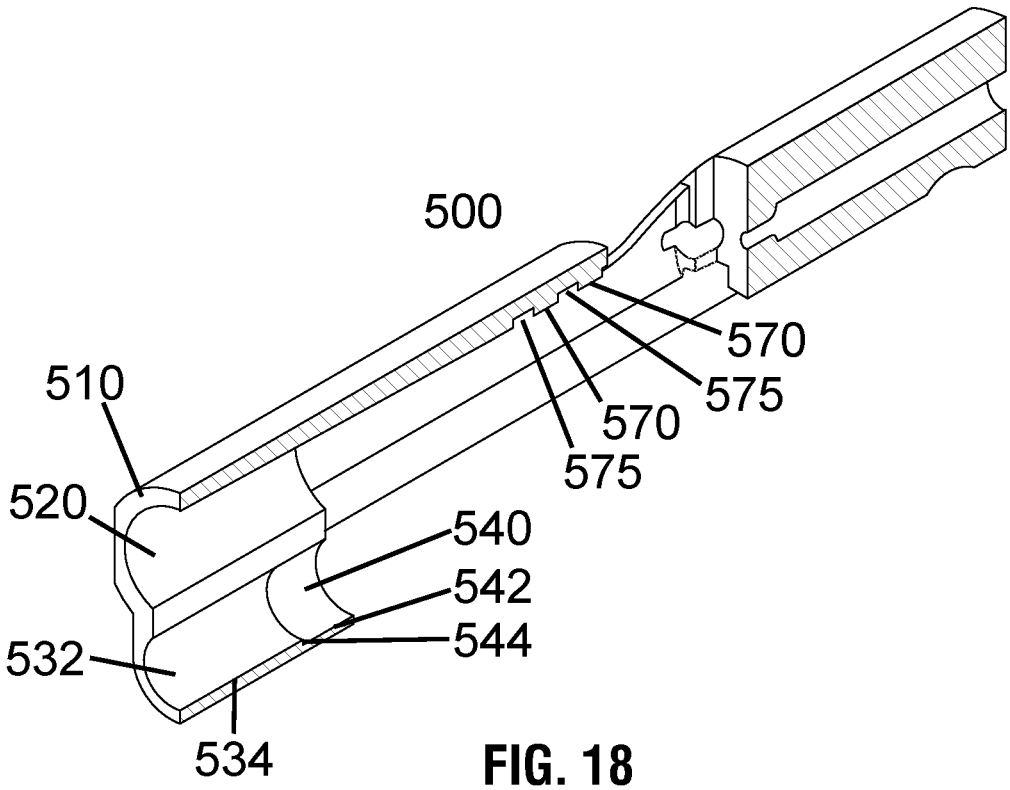

FIG. 17 and FIG. 18 present a simplified depiction of an embodiment of a pistol slide that may be used with compensator 100 and barrel 400. As shown, slide 500 comprises spring tunnel 530 enclosing the bottom of the front end portion of slide 500, which otherwise remains open as illustrated by the cross-section of FIG. 18. In this embodiment, slide 500 comprises muzzle end face 510, barrel boring 520, and spring tunnel boring 532 disposed in spring tunnel 530. Preferably, spring tunnel boring 532 is generally cylindrical, except that the top of spring tunnel boring 532 is open to the bottom of barrel boring 520. As shown, spring tunnel boring 532 is extended at the rear by plug seat boring 540, formed by plug seat wall 542 formed in spring tunnel wall 534. A preferably planar plug seat shelf 544 is formed where spring tunnel boring 532 meets plug seat boring 540. At the top of the inside of the slide, locking recesses 575 are disposed to form locking lugs 570.

FIG. 19 through FIG. 22 present simplified depictions of embodiments of a spring plug, recoil spring, and guide rod that may be used with compensator 100, barrel 400, and slide 500. As shown, plug 700 comprises plug body 710, extended at one end by latch extension 750 and at the other end by plug seat body 740. The exterior end of latch extension 750 is terminated with latch extension face 755, which preferably is planar and perpendicular to the axis of rod bore 730, but which also may be radiused or slanted. A preferably planar plug seat face 745 is formed where plug body 710 abuts plug seat body 740. As shown, the outside diameter of plug seat body 740 is larger than the outside diameter of plug body 710, which in turn is larger than the outside diameter of latch extension 750. In this embodiment, the interior of plug 700 is traversed by spring bore 720 and rod bore 730, which preferably are cylindrical and coaxial. A preferably planar spring seat 725 is formed where rod bore 730 meets spring bore 720. As shown, the inside diameter of spring bore 720 is larger than the inside diameter of rod bore 730.

Figure 19:
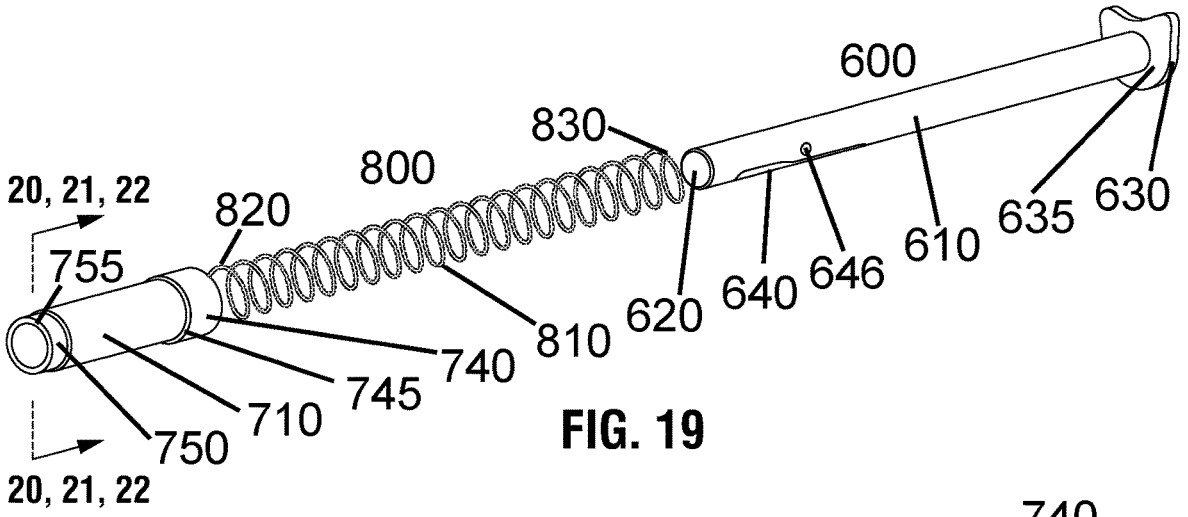
FIG. 19 through FIG. 22 present simplified depictions of embodiments of a spring plug, a recoil spring, and a guide rod that may be used with the compensator embodiment depicted in FIG. 1 through FIG. 14, the barrel embodiment depicted in FIG. 23 and FIG. 24, and the slide embodiment depicted in FIG. 17 and FIG. 18, with the cross section views of FIG. 20, FIG. 21, and FIG. 22, respectively, taken along reference lines 20 20, 21 21, and 22 22 of FIG. 19.
Figure 20:
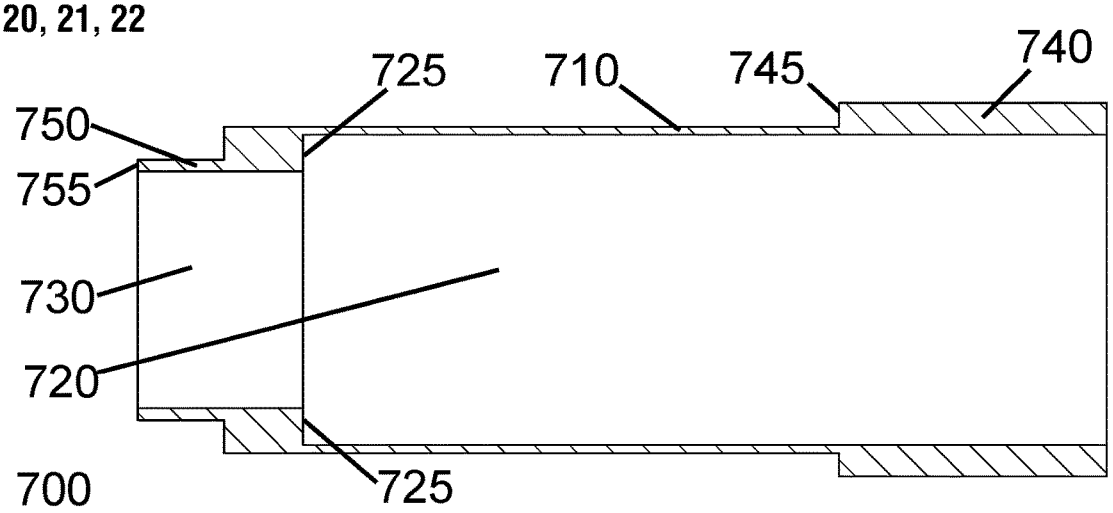
Figure 21:
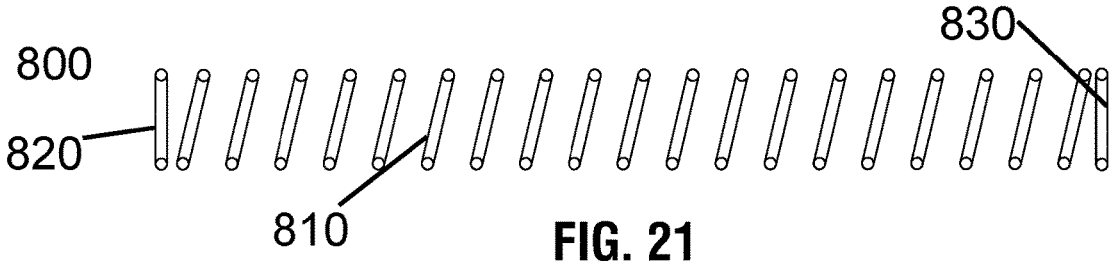
Figure 22:
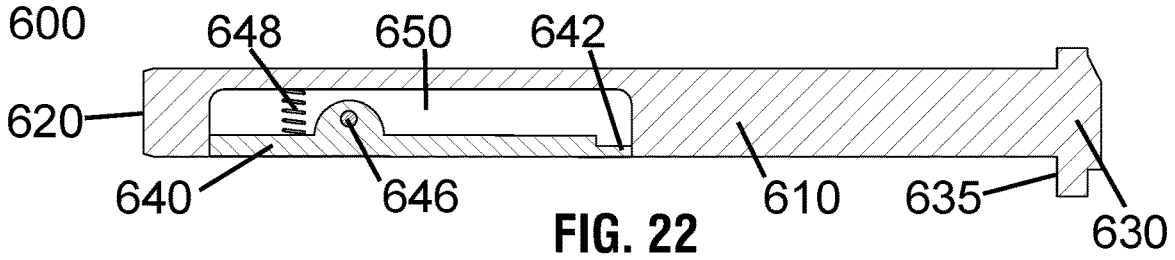

As shown in FIG. 19 and FIG. 21, spring 800 comprises helically wound spring body 810 terminating with a spring muzzle end 820 and spring breach end 830. Recoil springs such as spring 800 are well known in the art.

As shown in FIG. 19 and FIG. 21, guide rod 600 comprises rod body 610 terminated at the front by muzzle end 620 and at the rear by rod head 630. Preferably, rod body 610 is cylindrical with latch recess 650 formed longitudinally along rod body 610 and terminating proximal to muzzle end 620 of the rod. Preferably, as shown in this embodiment, guide rod 600 is equipped with elongated latch 640 disposed in latch recess 650. A latch hinge 646 is disposed perpendicular to the longitudinal axis of rod body 610 and intermediate of the ends of latch 640. A latch spring 648 biases latch 640 such that the ends of latch 640 are generally even with the exterior surface of rod body 610. The end of latch 640 located toward rod head 630 is equipped with latch lip 642, which has a thickness less than the adjacent portion of latch 640. In this embodiment, rod head 630 as a preferably planar rod head face 635 oriented perpendicular and adjacent to rod body 610.

Figure 25:
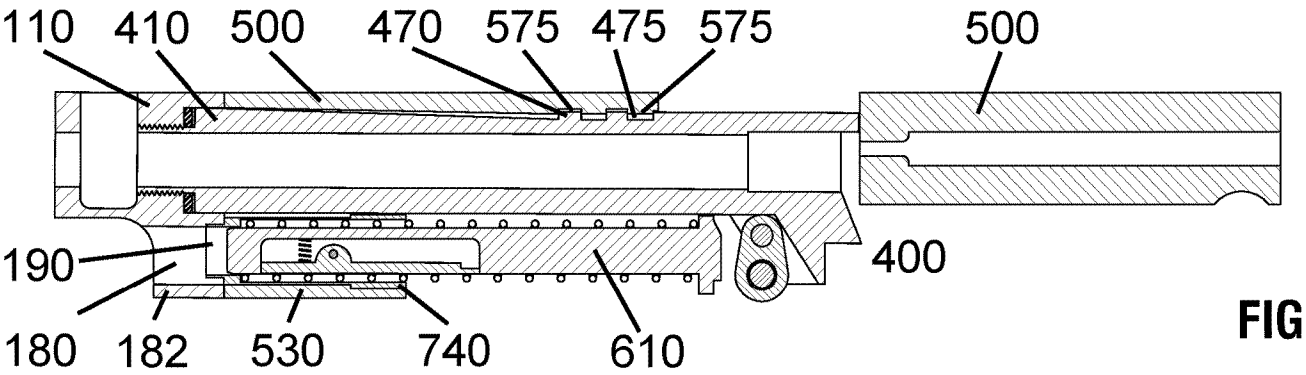
FIG. 25 through FIG. 27 depict the operation of the exemplary pistol compensator system embodiment depicted in FIG. 1 through FIG. 16, FIG. 19, and FIG. 20 used in conjunction with the barrel, slide, guide rod, and spring embodiments depicted in FIG. 23 and FIG. 24, FIG. 17 and FIG. 18, and FIG. 21, and FIG. 22, respectively.
Figure 26:
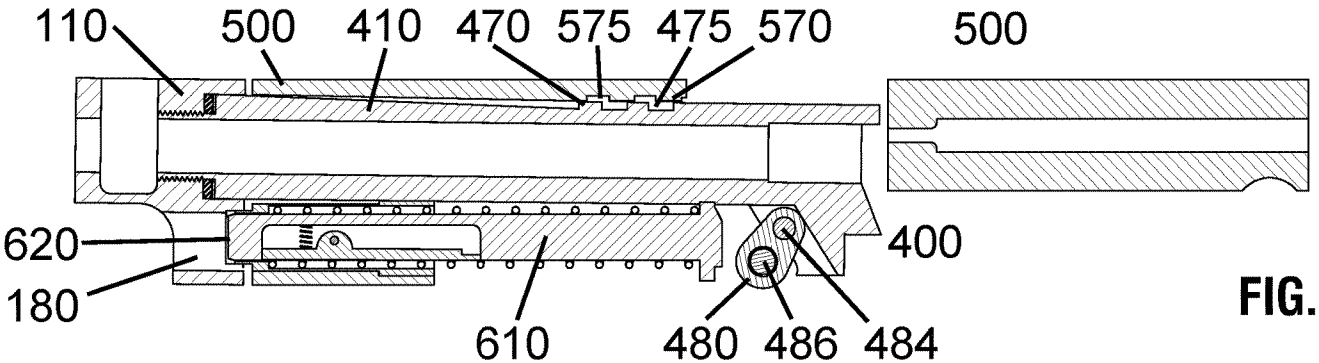
Figure 27:
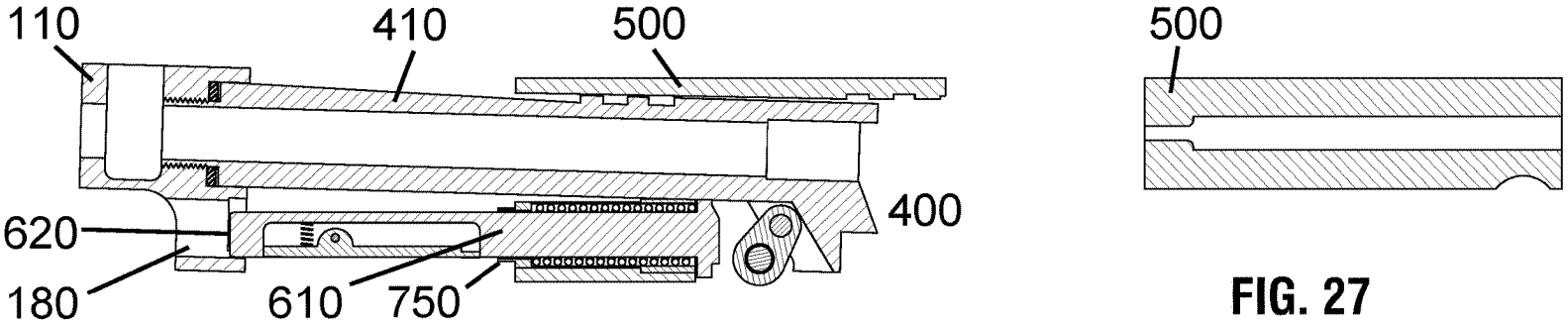
Figure 31:
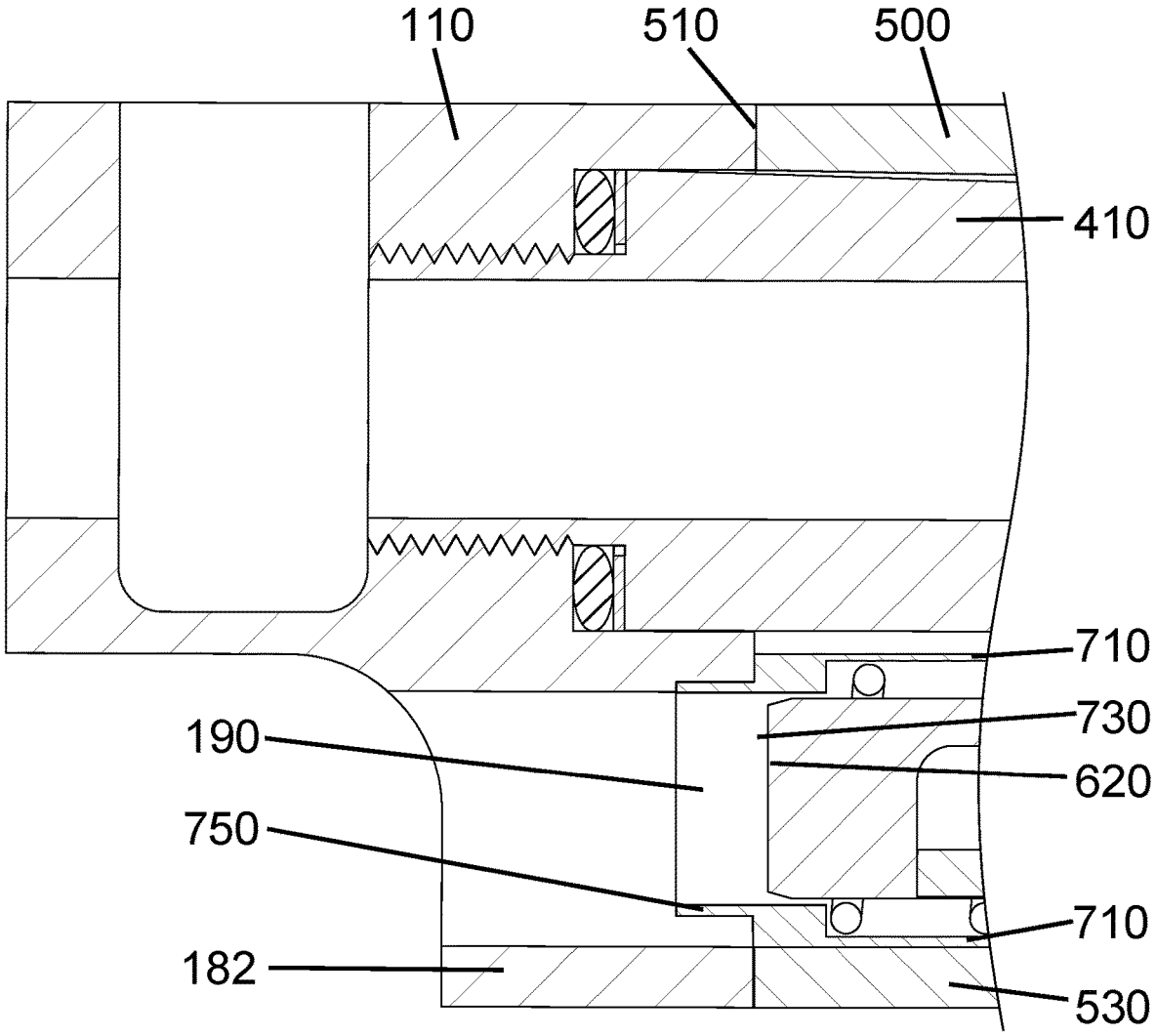
Figure 32:
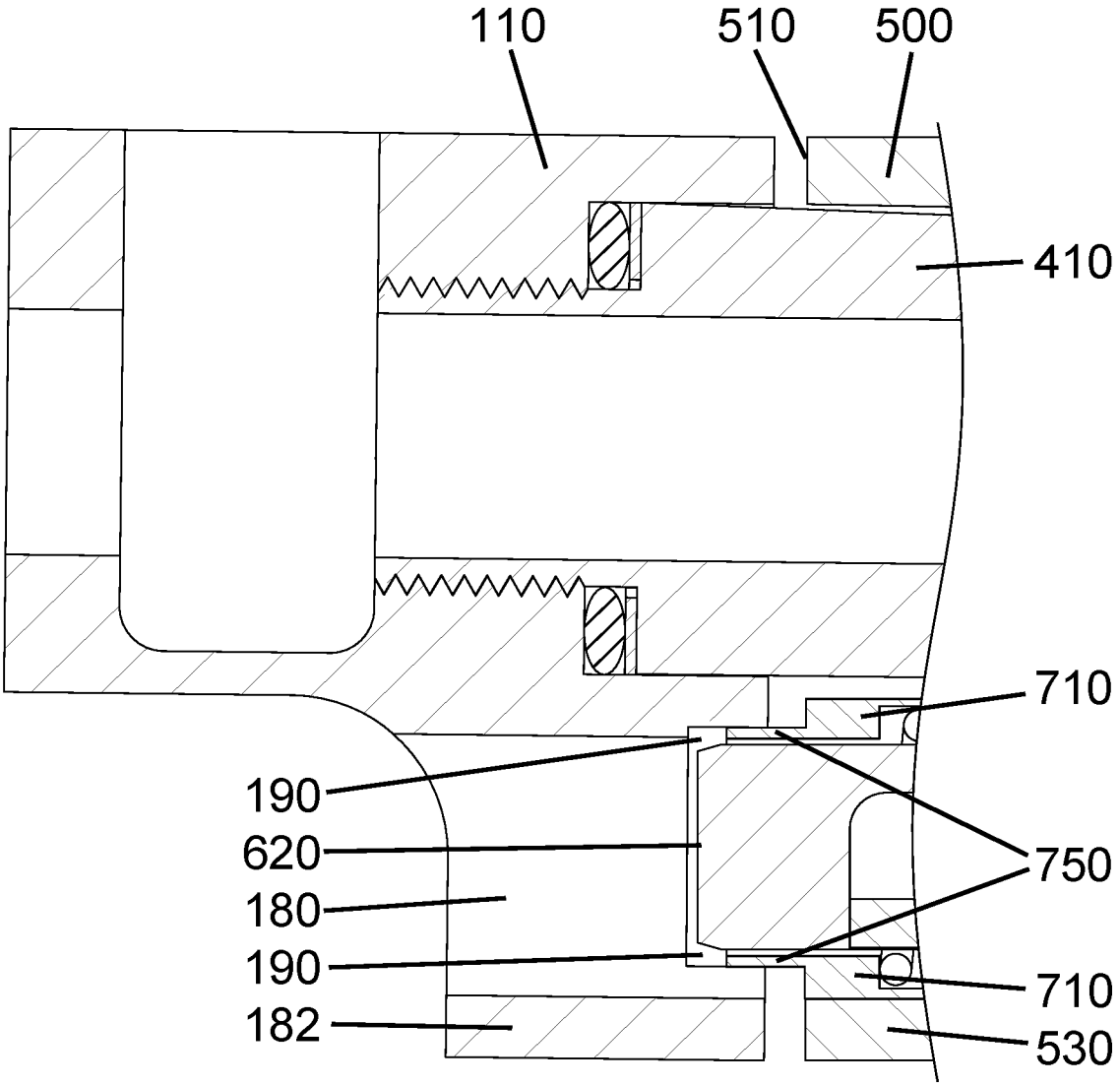
Figure 33:
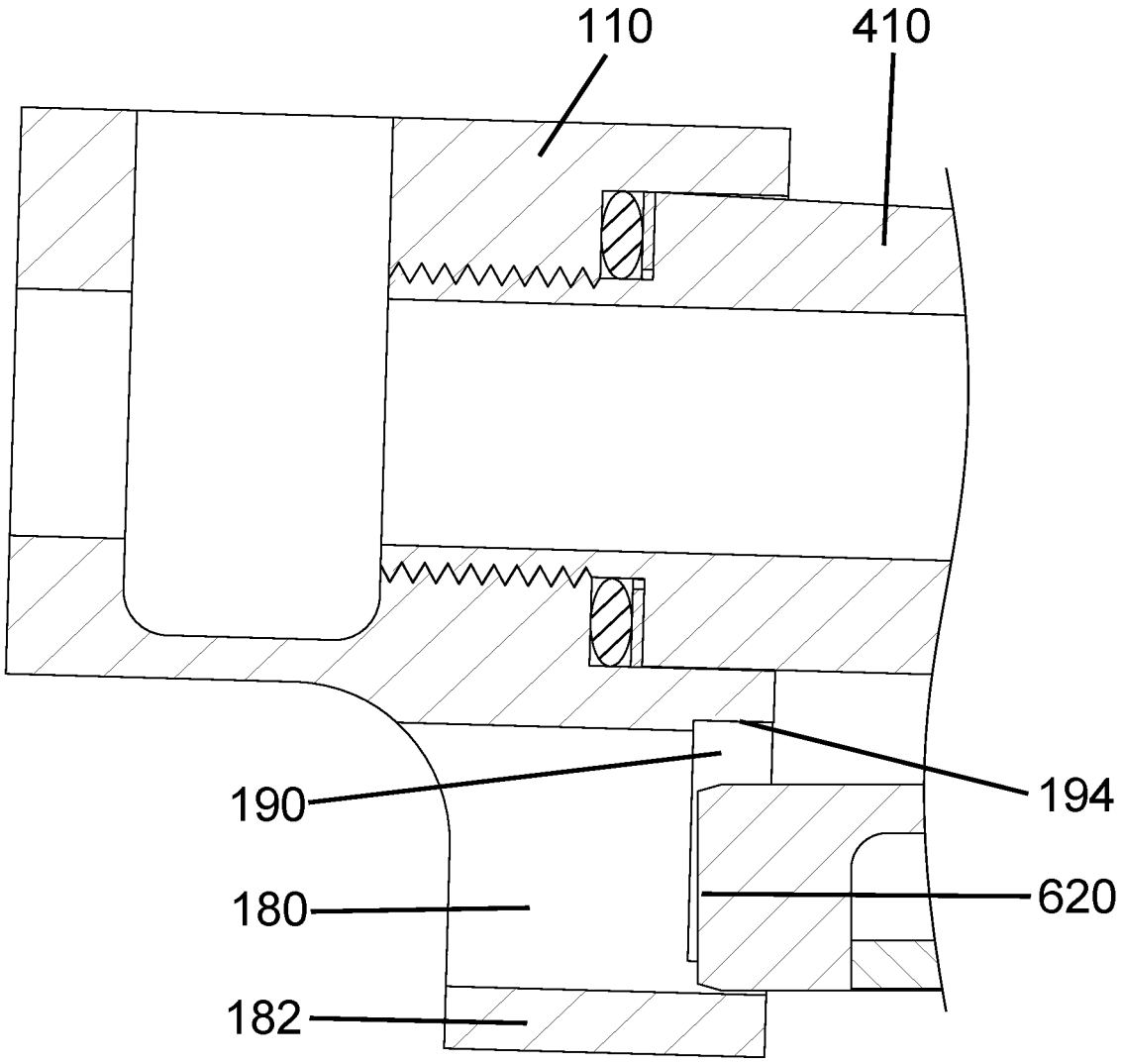

FIG. 25 through FIG. 27 depict the operation of the exemplary pistol compensator system illustrated in FIG. 1 through FIG. 16, FIG. 19, and FIG. 20 used in conjunction with barrel 400, slide 500, guide rod 600, and spring 800 illustrated in FIG. 23, FIG. 24, FIG. 17, FIG. 18, FIG. 21, and FIG. 22, respectively. For the following discussion, FIG. 31 presents a close-up of the left end of FIG. 25, FIG. 32 presents a close-up of the left end of FIG. 26, and FIG. 33 presents a close-up of the left in of FIG. 27. In FIG. 25 through FIG. 27, these parts are referenced as operated in conjunction with a pistol frame, not shown, preferably of the "1911" or "2011" configuration. For this description, slide 500 reciprocates right and left along the rails of the pistol frame, barrel 400 is attached to the pistol frame by insertion of the slide stop pin 486 through the lower hole in link 480 and through corresponding holes in the frame, and guide rod 600 is captured between barrel 400 and the pistol frame with rod head 630 abutting the frame and prevented from moving to the right (toward the rear of the frame) in the drawings.

As shown in FIG. 25 and FIG. 31, with slide 500 in battery prior to firing the pistol, locking lugs 470 engage locking recesses 575 and locking lugs 570 engage locking recesses 475. As shown, compensator body 110 and rod cavity bottom 182 are disposed proximally to muzzle end face 510 and spring tunnel 530, respectively. In this configuration, latch extension 750 extends past muzzle end face 510 and into plug cavity 190 of compensator body 110. Generally, muzzle end 620 extends into rod bore 730, but preferably does not extend past muzzle end face 510, and accordingly preferably does not extend into plug cavity 190 or rod cavity 180.

As shown in FIG. 26 and FIG. 32, after firing a cartridge the recoil causes slide 500 and barrel 400 to both travel toward the rear of the pistol (to the right in the figures). Because slide stop pin 486 is fixed to the frame, rearward travel of barrel 400 causes link 480 to rotate, thus pulling the rear end of barrel 400 down sufficiently to disengage locking lugs 470 and locking lugs 570 from locking recesses 575 and locking recesses 475, respectively. When barrel 400 unlocks from slide 500, slide 500 can continue its rearward travel while barrel 400 remain stationary. FIG. 26 and FIG. 32 depict the arrangement of components slightly after barrel 400 and slide 500 have unlocked and slide 500 has slightly continued its rearward travel. As shown, compensator body 110 and rod cavity bottom 182 have enlarged their separation from muzzle end face 510 and spring tunnel 530, respectively. At this point, because guide rod head 630 abuts the pistol frame and constrains guide rod 600 from moving toward the rear of the pistol, muzzle end 620 extends beyond muzzle end face 510 and into rod cavity 180. In addition, because plug seat body 740 remains stationary in plug seat boring 540 due to the interface of plug seat face 745 with plug seat shelf 544, latch extension 750 has begun to withdraw from plug cavity 190.

FIG. 27 and FIG. 33 depict the arrangement of components when slide 500 has completed its rearward movement with respect to the pistol frame. At this point, compensator 100 and slide 500 are at their maximum separation. Because plug seat body 740 remains stationary in plug seat boring 540 due to the interface of plug seat face 745 with plug seat shelf 544, latch extension 750 at this point is fully withdrawn from plug cavity 190. Also, at this point muzzle end 620 remains disposed in rod cavity 180 and, depending on configuration of the pistol, may have cammed vertically downward within the oval confines of rod cavity 180.

Figure 28:
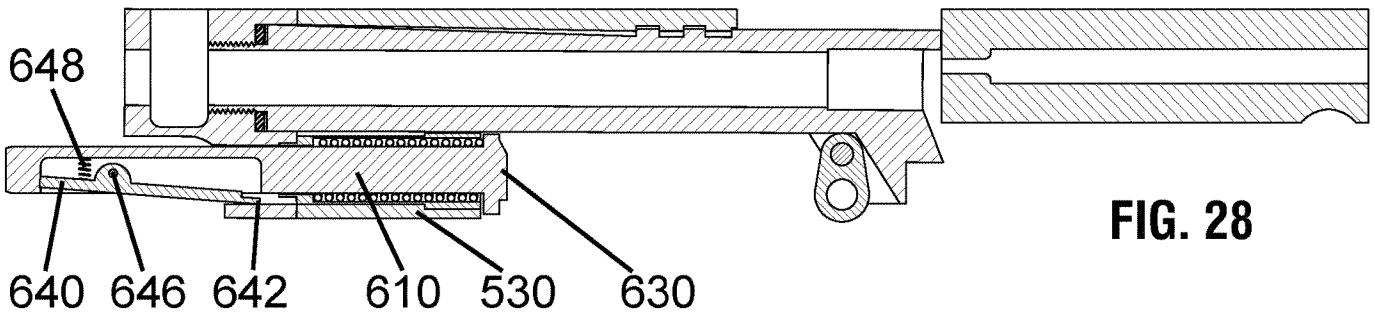
FIG. 28 through FIG. 36 depict an exemplary field disassembly of the top end of a pistol equipped with the pistol compensator system embodiment depicted in FIG. 1 through FIG. 16, FIG. 19, and FIG. 20 used in conjunction with the barrel, slide, guide rod, and spring embodiments depicted in FIG. 23 and FIG. 24, FIG. 17 and FIG. 18, and FIG. 21, and FIG. 22, respectively.
Figure 29:
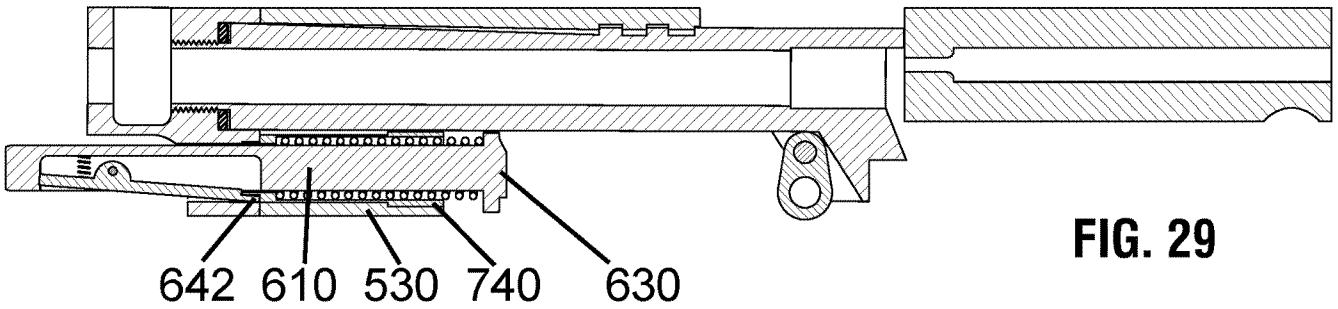
Figure 34:
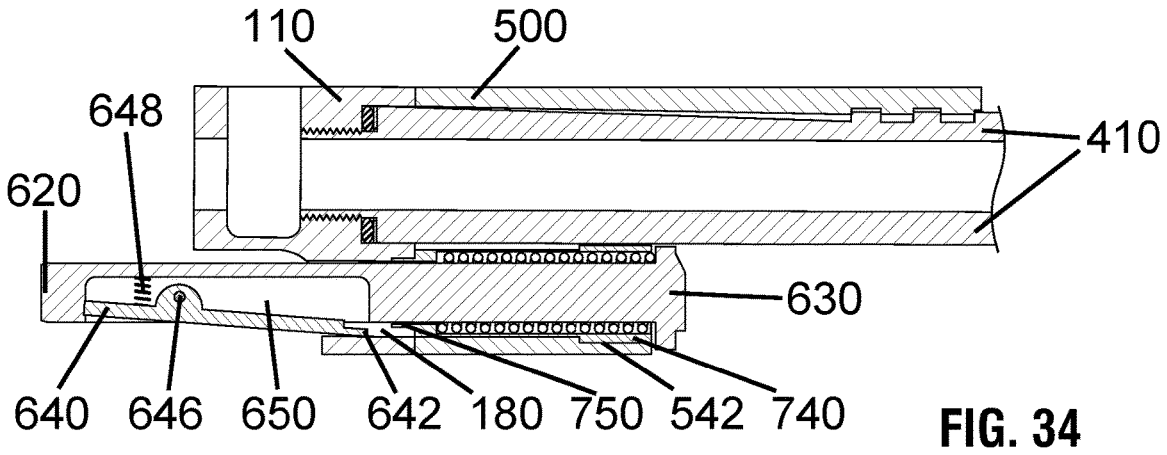
Figure 35:
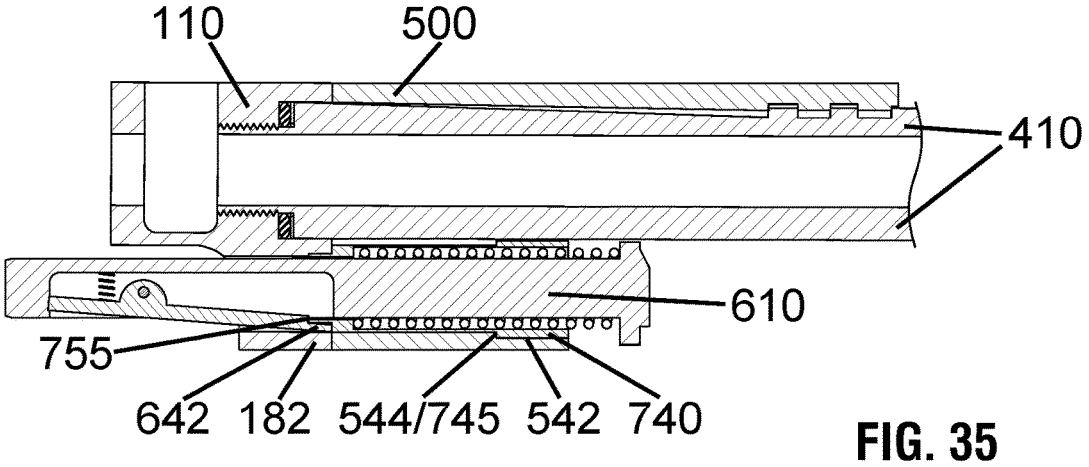
Figure 36:
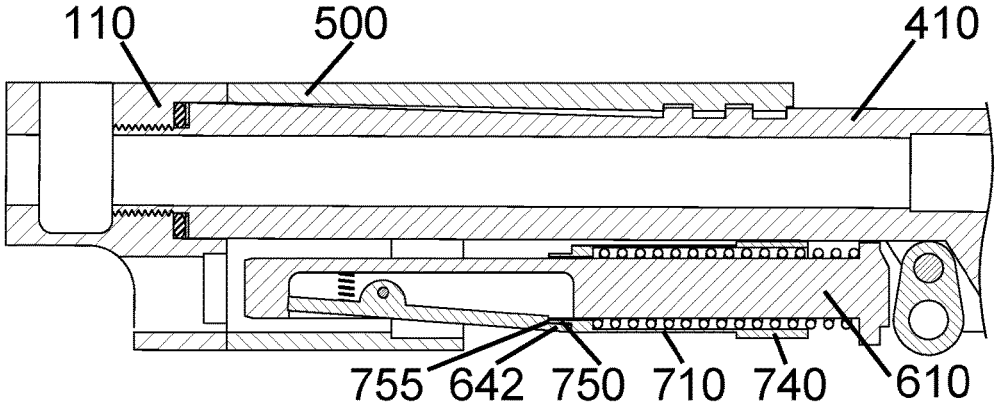

FIG. 28 through FIG. 36 depict an exemplary field disassembly of the top end of a pistol equipped with the pistol compensator system illustrated in FIG. 1 through FIG. 16, FIG. 19, and FIG. 20 used in conjunction with barrel 400, slide 500, guide rod 600, and spring 800 illustrated in FIG. 23, FIG. 24, FIG. 17, FIG. 18, FIG. 21, and FIG. 22, respectively. As used in this discussion, the term "top end" means the assembled compensator, barrel, slide, guide rod, spring, and spring plug, which can be removed from a typical "1911" or "2011" style pistol by removing the slide stop and sliding these components off the front of the pistol as a group. For the following discussion, FIG. 34 presents a close-up of the left end of FIG. 28, FIG. 35 presents a close-up of the left end of FIG. 29, and FIG. 36 presents a close-up of the left in of FIG. 30, with these figures depicting the top end removed from the pistol frame. Pictures of this process are provided IMAGE 1 through IMAGE 13 submitted as part of this application when filing (see "Drawings—other than black and white line drawings" in the IFW).

First, as shown in FIG. 28 and FIG. 34, rod head 630 is pressed toward the left, for example with a person's thumb, as far as possible. In the depicted configuration, rod head 630 is pressed all the way to the right end of spring tunnel 530. At this point, latch 640 is actuated, for example by pressing the end proximal to muzzle end 620 inward toward the center of rod body 610 with the person's other thumb, causing latch spring 648 to compress and latch 640 to rotate about latch hinge 646, resulting in latch lip 642 extending outward from latch recess 650.

Figure 37:
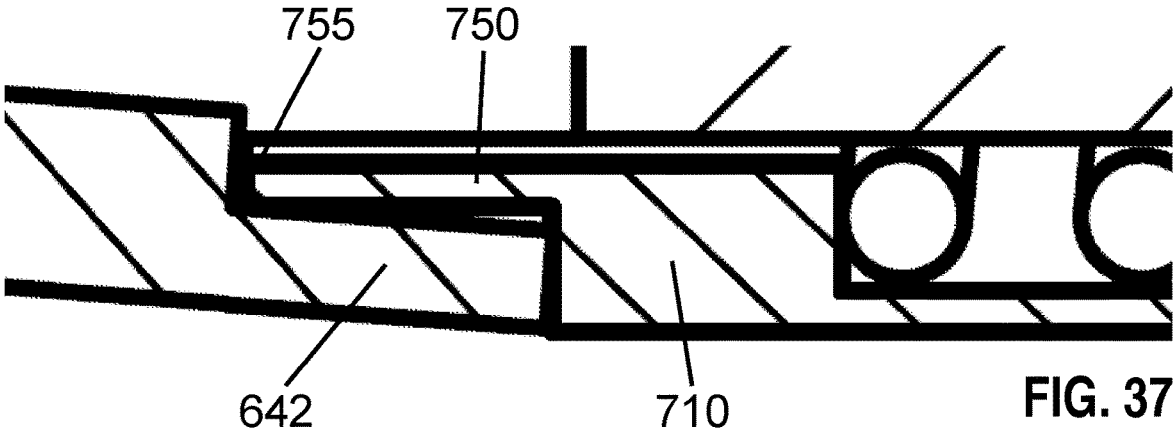
FIG. 37 and FIG. 38 provide closer details of aspects of the embodiment shown in FIG. 35.
Figure 38:
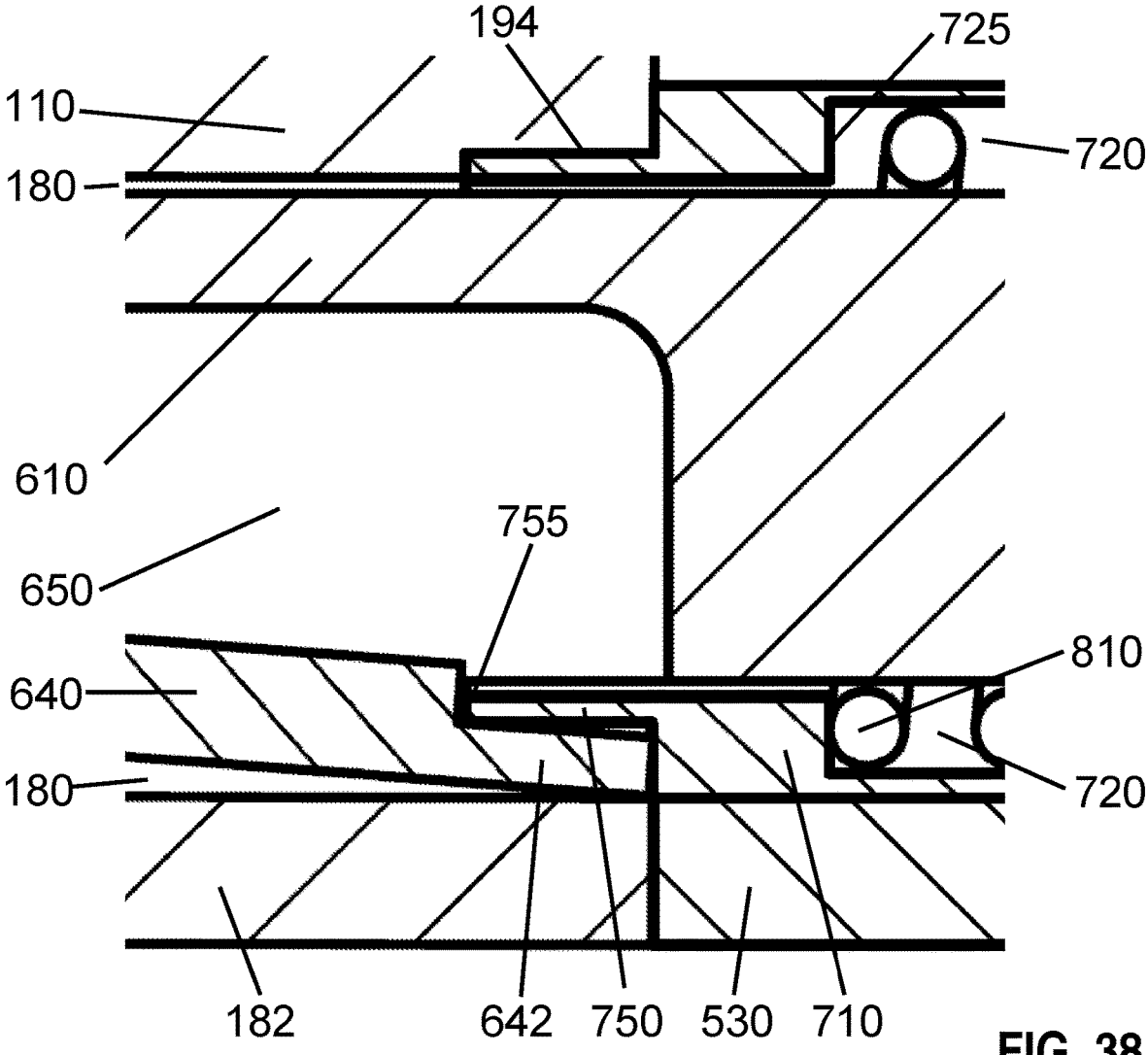
Figure 39:
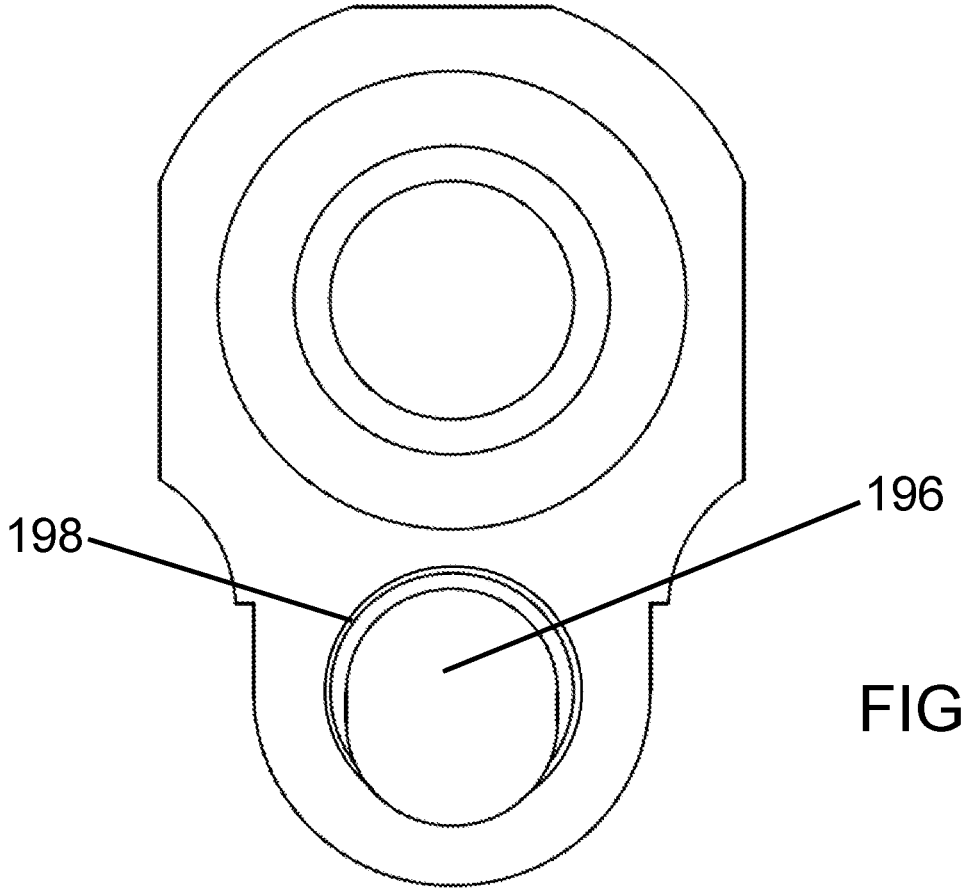
FIG. 39 through FIG. 42 depict an alternate preferred embodiment of a pistol compensator, with the cross reference views of FIG. 40, FIG. 41, and FIG. 42 depicting corresponding locations of FIG. 11, FIG. 9, and FIG. 16, respectively.
Figure 40:
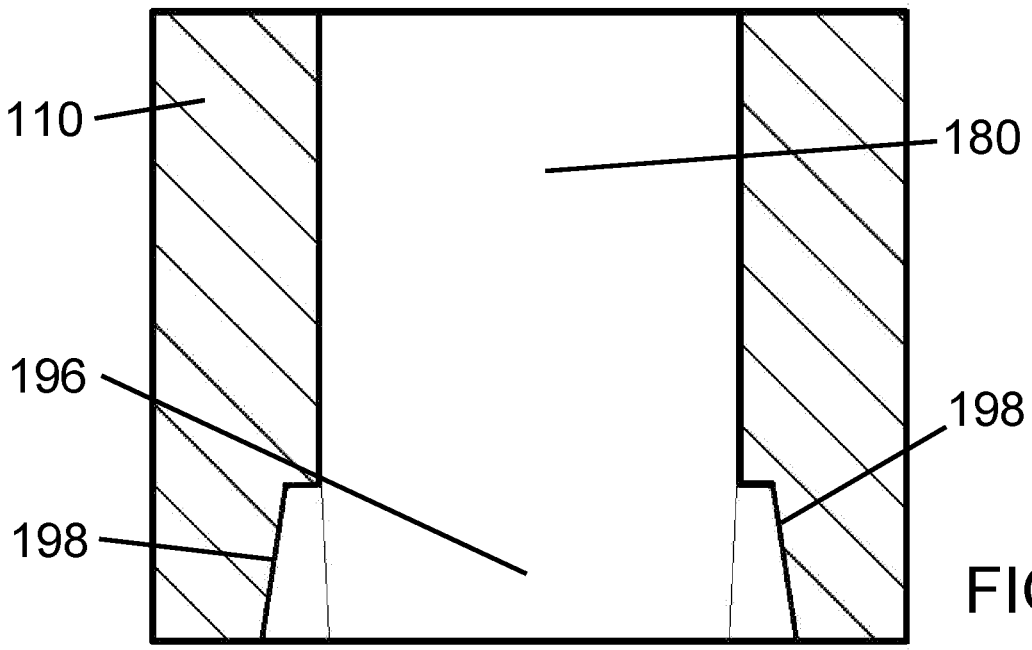
Figure 41:
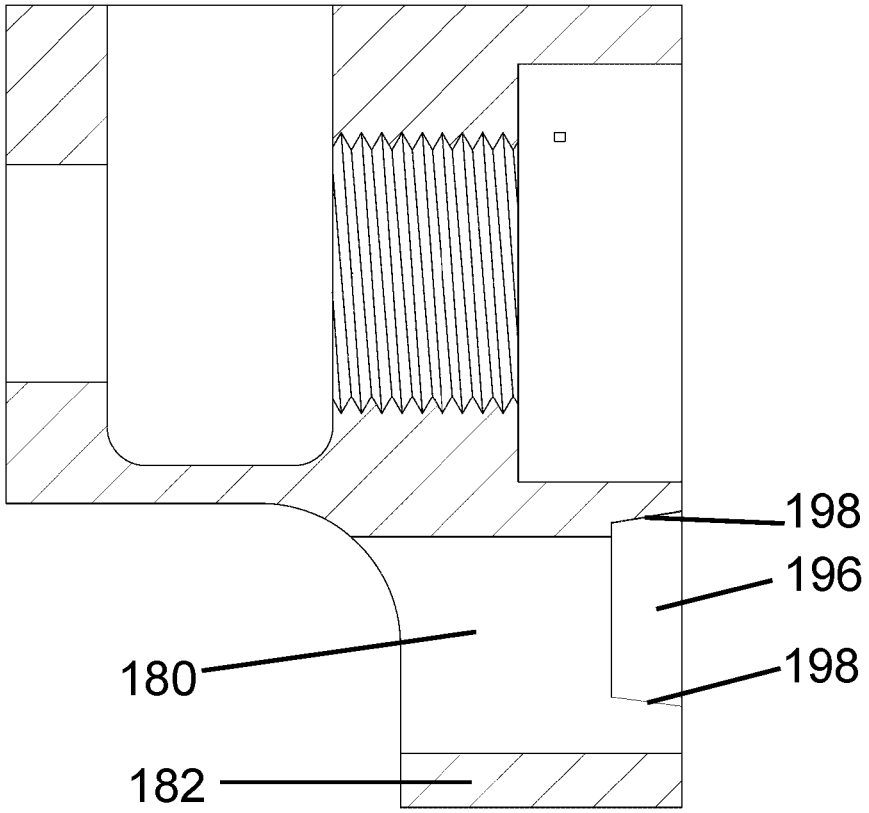
Figure 42:
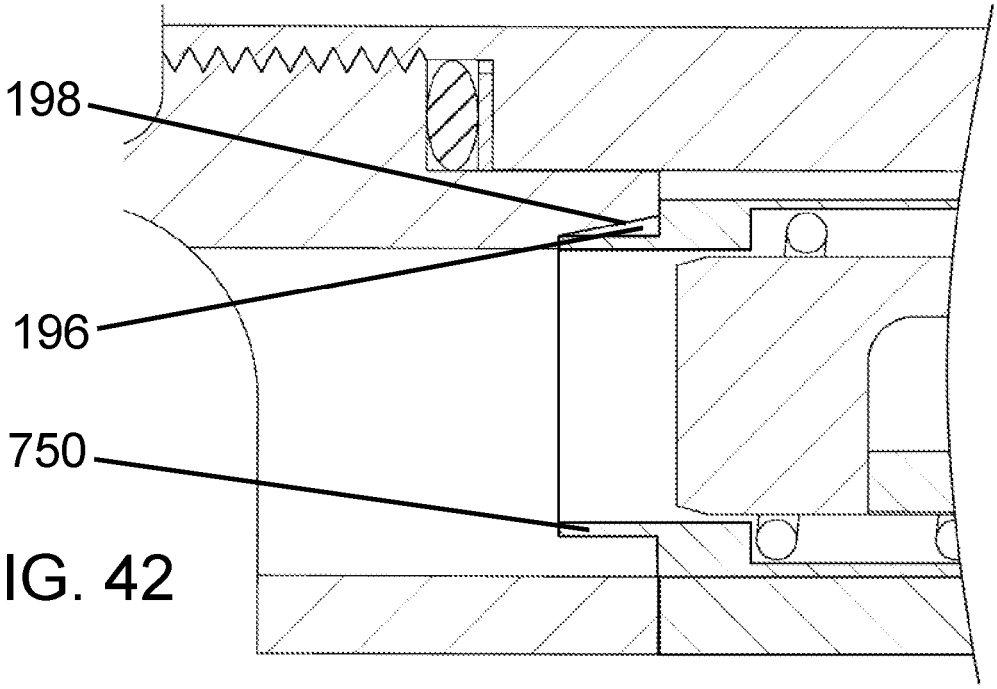

Next, as shown in FIG. 29 and FIG. 35, pressure on rod head 630 is released gradually until latch lip 642 catches on latch extension face 755. At this point, all pressure can be removed from rod head 630. Although spring 800 is still compressed, with spring muzzle end 820 exerting a leftward force on spring seat 725 and spring breach end 830 exerting a leftward force on rod head face 635, guide rod 600 will not project out of plug 700 because those parts are captured by the interface of latch lip 642 and latch extension face 755. The vertical oval configuration of rod cavity 180 helps prevent relative lateral movement and rotation of compensator body 110 with respect to guide rod 600 when the pistol operates from a discharge (for example as shown in FIG. 25 through FIG. 27), but allows sufficient clearance for latch lip 642 to extend out of latch recess 650 and travel through rod cavity 180 in that extended state, for example as shown in FIG. 34 and FIG. 35. Closer detail of the engagement of latch lip 642 with latch extension face 755 shown in FIG. 35 is provided by FIG. 37 and FIG. 38.

Figure 30:
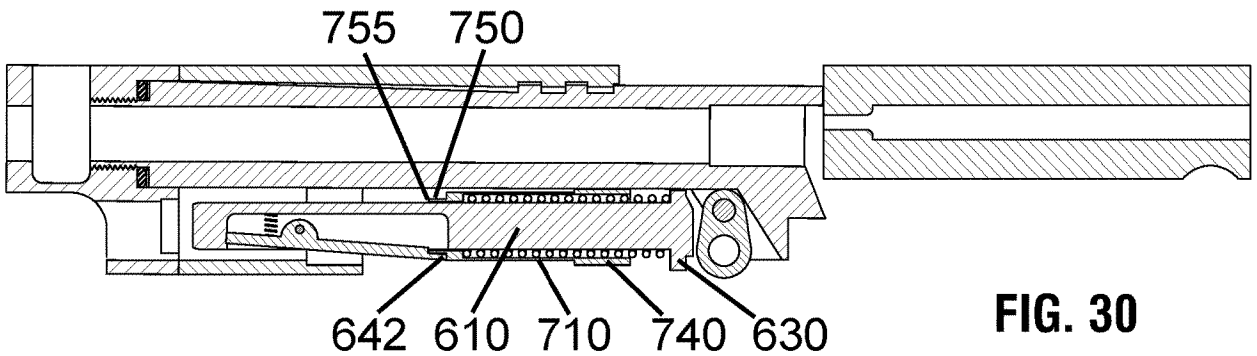

Now, as shown in FIG. 30 and FIG. 36, with guide rod 600 captured with plug 700, guide rod 600, plug 700, and spring 800 may be completely withdrawn through spring tunnel 530 collectively. At this step, no additional force is needed to compress spring 800 for this removal operation.

Unless extraordinary tolerances are imposed when threading barrels and compensators, there can be no reasonable prediction of the orientation of compensator 100 with respect to barrel 400 when the threads are fully engaged and the parts are sufficiently tightened. To avoid this issue, a preferred embodiment is deployed with an elastomeric spacer, such as O-ring 200, that provides a certain amount of "slack" in the rotational orientation of compensator 100 with respect to barrel 400 when those components are sufficiently tight to avoid unintended loosening. To provide additional flexibility in the orientation of compensator 100 with respect to barrel 400 when those components are sufficiently tight to avoid unintended loosening, a preferred compensator system comprises an assortment of shims having different thicknesses, such as thick shim 310, intermediate shim 320, and thin shim 330. Preferably, the shim assortment at least comprises common thicknesses approximately equal to 100%, 40%, and 15% of the thread pitch. In a preferred embodiment, barrel 400 and compensator 100 are configured with threads 450 and threads 140, respectively, that are ½ inch by 28 threads per inch. Accordingly, with threads 140 engaged with threads 450, one turn of compensator 100 about barrel 400 moves compensator 100 approximately 0.036 inch in relation to muzzle face 430. Accordingly, for a deployment having 28 thread per inch threads, thick shim 310 may be provided as a 0.035 inch shim, intermediate shim 320 may be provided as a 0.015 inch shim, and thin shim 330 may be provided as a 0.005 inch shim.

In a preferred method of attaching compensator 100 to barrel 400, O-ring 200 is placed in barrel cavity 120 adjacent to barrel cavity seating face 126. Generally, thick shim 310 is next placed in barrel cavity 120 adjacent to O-ring 200. The portion of barrel 400 having threads 450 is then passed through center hole 340 of the shim and through center opening 230 of the O-ring, to engage threads 140 of threaded bore 130. When the corresponding threads are engaged, compensator 100 is rotated with respect to barrel 400 until those components are sufficiently tight to avoid unintended loosening. If at this point compensator 100 is properly aligned with respect to barrel 400, the attachment process is complete. If not, compensator 100 may be rotated a bit further with respect to barrel 400, but if sufficient tightening cannot be achieved with proper orientation at a maximum compression of O-ring 200, then compensator 100 should be removed, thick shim 310 replaced with intermediate shim 320, and the tightening process repeated. If at this point sufficient tightening cannot be achieved using intermediate shim 320, then it should be removed and replaced with thin shim 330 and the tightening process repeated. The thickness of O-ring 200 preferably will be selected so that regardless of the matchup between the respective threads of compensator 100 and barrel 400, at least the thinnest of the shims can be used and sufficient tightening achieved. Other embodiments, however, may be deployed with no O-rings at all by including in the compensator system a large selection of shim thickness. Still other embodiments may comprise an O-ring sufficiently thick that a shim may or may not be needed in a particular installation. Yet other embodiments may be configured to allow installation of more than one shim at a time or to allow plural O-rings.

In a preferred embodiment, O-ring 200 may be deployed with an inner circumference 220 that is slightly less than the outer circumference of threads 450, and with an outer circumference 210 that is greater than the inner circumference of barrel cavity wall 124. If an embodiment comprises shoulder 460 or a similar component between threads 450 and muzzle face 430, preferably the inner diameter of O-ring 200 will be sufficiently small that when O-ring 200 is compressed as in FIG. 16, then the inside of O-ring 200 will press tightly against shoulder 460 or similar component. Providing vertical compression of O-ring 200 between barrel cavity wall 124 and barrel threads 450 or shoulder 460 helps to center compensator 100 on barrel 400 and enhance collinearity of exit bore 150 and barrel inner bore 420. The elasticity of O-ring 200 further exerts a separating force between compensator 100 and barrel 400 when O-ring 200 is horizontally compressed, which better nests threads 140 with threads 450 to further enhance the stability and centering of compensator 100 on barrel 400 and the collinearity of exit bore 150 and barrel inner bore 420.

Preferably, O-ring 200 is placed in barrel cavity 120 adjacent to barrel cavity seating face 126, and a shim 300 placed between O-ring 200 and muzzle face 430. Because outer circumference 210 preferably is greater than the inner circumference of barrel cavity wall 124, O-ring 200 generally will tend to rotate with compensator 100. Without a shim 300 placed between O-ring 200 and muzzle face 430, the barrel-side face of O-ring 200 could abrade, tear, or otherwise be damaged by direct rotation against muzzle face 430 while tightening compensator 100 on barrel 400. With a shim 300 placed between O-ring 200 and muzzle face 430, shim 300 will generally rotate with O-ring 200 due to a greater coefficient of friction between shim 300 and O-ring 200 than between shim 300 and muzzle face 430. Other embodiments, however, may have the shim deployed adjacent to barrel cavity seating face 126 with O-ring 200 adjacent to muzzle face 430. Yet other embodiments may be deployed with O-ring 200 placed between plural shims 300, with a shim 300 disposed between barrel cavity seating face 126 and O-ring 200, and another shim 300 between muzzle face 430 and O-ring 200.

In preferred embodiments, the orientation and fixation of compensator 100 with respect to barrel 400 is enhanced by further means in addition to the use of an elastomeric spacer such as O-ring 200. For example, when slide 500 is in battery, latch extension 750 of plug 700 is disposed in plug cavity 190, thus preventing any significant rotation of compensator 100 with respect to barrel 400. When slide 500 is out of battery, barrel 400 with compensator 100 attached moves toward the rear of the pistol, causing muzzle end 620 of guide rod 600 to enter rod cavity 180 of compensator 100, thus preventing any significant rotation of compensator 100 with respect to barrel 400 even though latch extension 750 has at this point withdrawn from plug cavity 190.

Preferably, a compensator will be deployed with a rod cavity having an oval cross-section, such as rod cavity 180 depicted in the figures. The oval profile of rod cavity 180 provide sufficient clearance to allow the use of a guide rod having a latch, such as latch 640 of the figures. In addition, an oval rod cavity will allow the guide rod room to cam, for example as seen in FIG. 33, which may occur in some pistol configurations.

Another preferred embodiment deploys a chamfered or beveled plug cavity in compensator 100. For example, all aspects of the embodiment of compensator 100 shown in FIG. 39 through FIG. 42 and FIG. 44 are the same as the embodiment of compensator 100 shown in FIG. 1 through FIG. 16 and FIG. 25 through FIG. 36 except for the plug cavity. Plug cavity 190 is formed as a partial right circular cylindrical boring having a central axis parallel to threaded bore 130 and exit bore 150, with the bottom part of the circular cylinder open to rod cavity 180. Accordingly, plug cavity wall 194 forms a partial cylindrical wall. In contrast, plug cavity 196 depicted in FIG. 39 through FIG. 42 and FIG. 44 is formed as right circular frustoconical boring having a central axis parallel to threaded bore 130 and exit bore 150, with the bottom part of the conical frustum open to rod cavity 180. Accordingly, plug cavity wall 198 forms a partial conical frustum wall. With some pistol configurations, frustoconical plug cavity 196 may facilitate engagement of compensator 100 and latch extension 750 of plug 700, and help bring compensator 100 into better alignment with slide 500.

Figure 43:
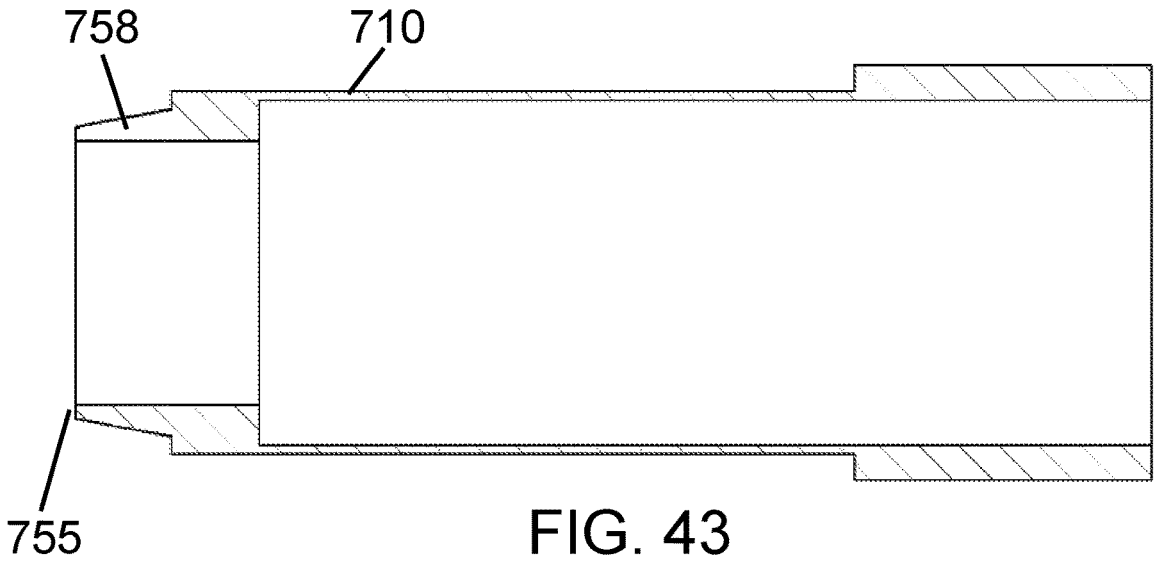
FIG. 43 and FIG. 44 depict an alternate preferred embodiment of a spring plug, with the cross reference views depicting corresponding locations of FIG. 20 and FIG. 16, respectively.
Figure 44:
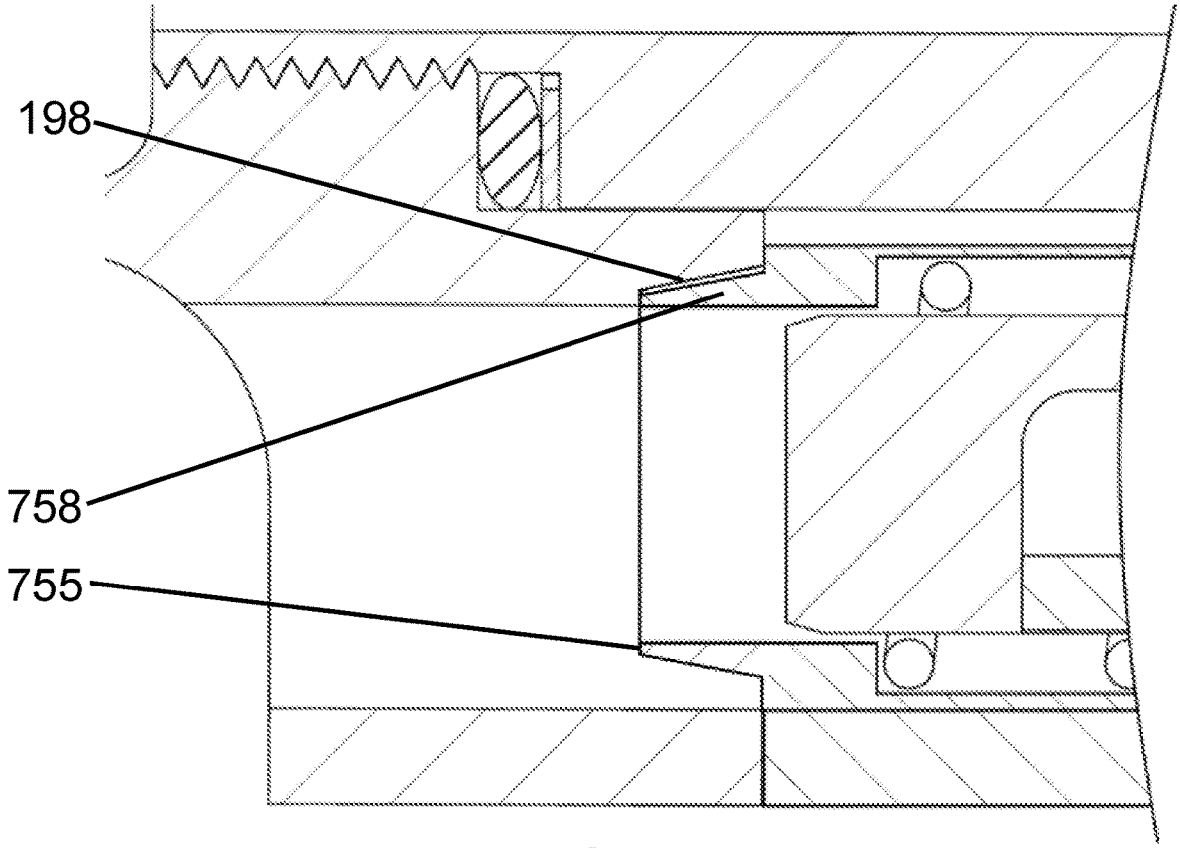

Some embodiments deployed with frustoconical plug cavity 196 may also have a plug 700 comprising a frustoconical latch extension. For example, all aspects of the embodiment of plug 700 shown in FIG. 43 and FIG. 44 are the same as the embodiment of plug 700 shown in FIG. 19, FIG. 20, FIG. 25 through FIG. 32, and FIG. 34 through FIG. 38 except for the latch extension. Latch extension 750 is formed as an open right circular cylinder. In contrast, tapered latch extension 758 is formed as an open conical frustum. In conjunction with frustoconical plug cavity 196, tapered latch extension 758 can further help bring compensator 100 into better alignment with slide 500 in some pistol configurations.

Figure 45:
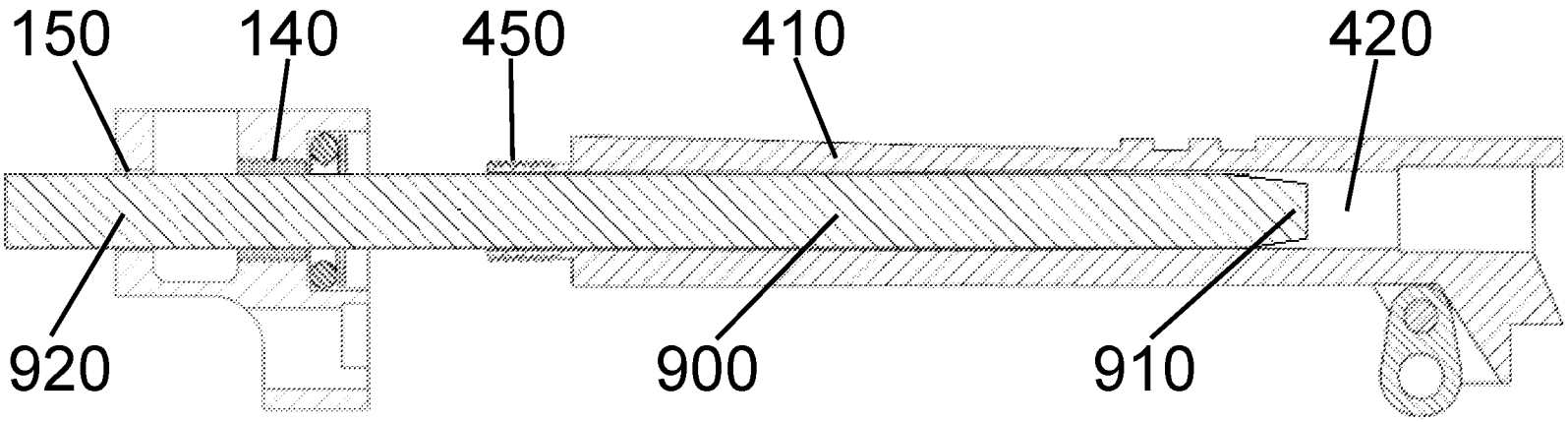
FIG. 45 depicts a cross section view of a pilot shaft embodiment shown in a cross sectional view of a preferred embodiment.

An embodiment of a pilot shaft used to facilitate attachment of compensator 100 to barrel 400 is depicted in FIG. 45. To mount compensator 100 to barrel 400, tapered tip 910 of pilot shaft 900 is placed through the muzzle end of barrel tube 410 toward the cartridge chamber. O-ring 200 and a shim 300 are placed in barrel cavity 120 of compensator 100. Then, compensator 100, with O-ring 200 and shim 300 disposed in barrel cavity 120, are collectively placed on compensator tip 920 of pilot shaft 900 and slid along pilot shaft 900 toward barrel tube 410 until threads 140 are ready to engage threads 450. With pilot shaft 900 holding threaded bore 130 in coaxial alignment with inner bore 420, threads 140 are then engaged with threads 450 and compensator 100 is rotated threads 450 of barrel tube 410 until compensator 100 is sufficiently tight to avoid unintended loosening. By holding threaded bore 130 in coaxial alignment with inner bore 420 during attachment of compensator 100 to barrel 400, the risk of cross-threading or other alignment problems are reduced.

After appreciating this disclosure, those of skill in the art will recognize that the steps of the various methods, processes, and other techniques disclosed herein need not be performed in any particular order, unless otherwise expressly stated or logically necessary to satisfy expressly stated conditions. In addition, after appreciating this disclosure, those skilled in the art will recognize that other embodiments may have a variety of different forms of devices and systems, and that various changes, substitutions, and alterations may be made without departing from the spirit and scope of this disclosure. The described embodiments are illustrative only and are not restrictive, and the scope of this disclosure is defined solely by the following claims and any further claims in this application or any application claiming priority to this application.

The invention claimed is:

1. A pistol compensator system comprising:

a compensator comprising a body, a barrel cavity, a threaded bore, a rod cavity having a vertical oval configuration, and a plug cavity;

an elastomeric spacer;

an assortment of variously sized shims;

a spring guide rod comprising a muzzle end; and a spring plug comprising a latch extension.

2. A method of equipping a pistol with a compensator comprising the steps of:

acquiring a pistol comprising a barrel and a slide;

acquiring pistol compensator system in accordance with claim 1;

attaching the compensator to threads on the muzzle end of the barrel with the elastomeric spacer and at least one of the shims between the compensator and the barrel;

rotating the compensator about the barrel so that when the pistol is in battery, the latch extension is disposed in the plug cavity, and when the pistol is out of battery the muzzle end of the guide rod is disposed in the rod cavity.

3. A method of attaching a compensator to a threaded pistol barrel comprising the steps of:

(a) acquiring a compensator comprising internal threads, a rod cavity having a vertical oval configuration, a pistol barrel comprising external threads, an elastomeric spacer, and an assortment of variously sized shims;

(b) selecting the thickest of the variously sized shims;

(c) engaging the compensator threads onto the barrel threads with the elastomeric spacer and the selected shim between the compensator and the barrel;

(d) rotating the compensator about the barrel until the compensator is tight;

(e) determining if the tightened compensator is oriented correctly on the barrel;

(f) if the tightened compensator is incorrectly oriented on the barrel, selecting the next thickest of the variously sized shims; and (g) repeating steps (c), (d), (e), and (f) until the tightened compensator is oriented correctly on the barrel.

4. A pistol compensator system configured for deployment on a pistol that comprises a barrel having (i) a barrel tube with an unthreaded end terminating at a muzzle face and (ii) a threaded muzzle extension extending from the muzzle face and having a first diameter, the pistol compensator system comprising:

a spring guide rod comprising a muzzle end;

a spring plug comprising a latch extension;

a compensator comprising a body configured with a barrel cavity sized to accept at least a portion of the unthreaded end of the barrel tube and having a second diameter, a threaded bore sized to accept the threaded muzzle extension, a rod cavity having a vertical oval configuration, and a plug cavity formed in an upper rear portion of the rod cavity and sized to accept the latch extension;

an elastomeric spacer having an outer diameter greater than the second diameter and an inner diameter smaller than the first diameter; and a shim;

the system having an assembled configuration on the pistol in which at least a portion of the unthreaded end of the barrel tube is disposed in the barrel cavity, at least a portion of the threaded muzzle extension is disposed in the threaded bore, the shim is disposed around the threaded muzzle extension with one side of shim disposed adjacent to the muzzle face and a second side of the shim disposed adjacent to the elastomeric spacer, the elastomeric spacer is disposed around the threaded muzzle extension with one side of the elastomeric spacer adjacent to an inside face of the barrel cavity and a second side of the elastomeric spacer adjacent to the shim, the elastomer space is compressed vertically between the barrel cavity and the threaded muzzle extension and horizontally between the barrel cavity and the shim, and the latch extension is disposed in the plug cavity when the pistol is in battery, and the muzzle end of the spring guide rod is disposed in the rod cavity when the pistol is out of battery.

* * * * *